US009370727B2

(12) United States Patent
Deluz

(10) Patent No.: US 9,370,727 B2
(45) Date of Patent: Jun. 21, 2016

(54) INTERACTIVE SYNTHESIZER HOOP INSTRUMENT

(71) Applicant: Patrick Deluz, San Diego, CA (US)

(72) Inventor: Patrick Deluz, San Diego, CA (US)

( * ) Notice: Subject to any disclaimer, the term of this patent is extended or adjusted under 35 U.S.C. 154(b) by 0 days.

(21) Appl. No.: 13/732,441

(22) Filed: Jan. 2, 2013

(65) Prior Publication Data

US 2013/0225037 A1 Aug. 29, 2013

Related U.S. Application Data

(63) Continuation-in-part of application No. 11/343,416, filed on Jan. 31, 2006, now Pat. No. 8,342,901.

(60) Provisional application No. 60/648,907, filed on Feb. 1, 2005.

(51) Int. Cl.

| | |
|---|---|
| ***A63H 30/00*** | (2006.01) |
| ***A63H 33/26*** | (2006.01) |
| ***A63B 19/00*** | (2006.01) |
| ***F21V 23/04*** | (2006.01) |
| ***F21S 10/02*** | (2006.01) |
| *A63B 71/06* | (2006.01) |

(52) U.S. Cl.

CPC ..... *A63H 33/26* (2013.01); *A63B 19/00* (2013.01); *F21S 10/023* (2013.01); *F21V 23/0471* (2013.01); *A63B 2071/0625* (2013.01); *A63B 2207/02* (2013.01); *A63B 2220/56* (2013.01); *A63B 2220/833* (2013.01)

(58) Field of Classification Search

USPC ..... 446/175, 242

See application file for complete search history.

(56) References Cited

U.S. PATENT DOCUMENTS

| | | | | | |
|---|---|---|---|---|---|
| 3,911,264 | A * | 10/1975 | Chao | 446/439 |
| 4,006,556 | A * | 2/1977 | Williams | 446/242 |
| 4,915,666 | A * | 4/1990 | Maleyko | 446/242 |
| 5,108,340 | A * | 4/1992 | Farrow | 446/242 |
| 5,145,443 | A * | 9/1992 | Vaisnys et al. | 446/242 |
| 6,036,573 | A * | 3/2000 | Huang | 446/242 |
| 6,165,040 | A * | 12/2000 | Burich | 446/242 |
| 6,265,984 | B1 * | 7/2001 | Molinaroli | 340/815.4 |
| 6,497,603 | B1 * | 12/2002 | Magers et al. | 446/242 |
| 2005/0255787 | A1 * | 11/2005 | Pak | 446/236 |

* cited by examiner

*Primary Examiner* — Tramar Harper

(57) ABSTRACT

A hoop containing lights (LEDs or EL wires) that vary output, based on, for example, movement of the user, through the use of electromechanical and electronic sensors and switches is disclosed. Different movements, circuits or programs cause the lights to respond differently to the same signals. The signals generated by the onboard sensors also are sent by radio signal to a receiver and through a computer and modulate volume, pitch, pan and tempo and also create distinct sounds and combinations of sounds. The coherent pattern of sounds and lights coming from the movements of the body creates a synergy of perception. The interactive synthesizer hoop is an instrument that allows one to paint pictures of feelings, and hear sounds associated with the whole range of human movement and can function as an audio-visual-kinesthetic mirror and communication tool.

19 Claims, 35 Drawing Sheets

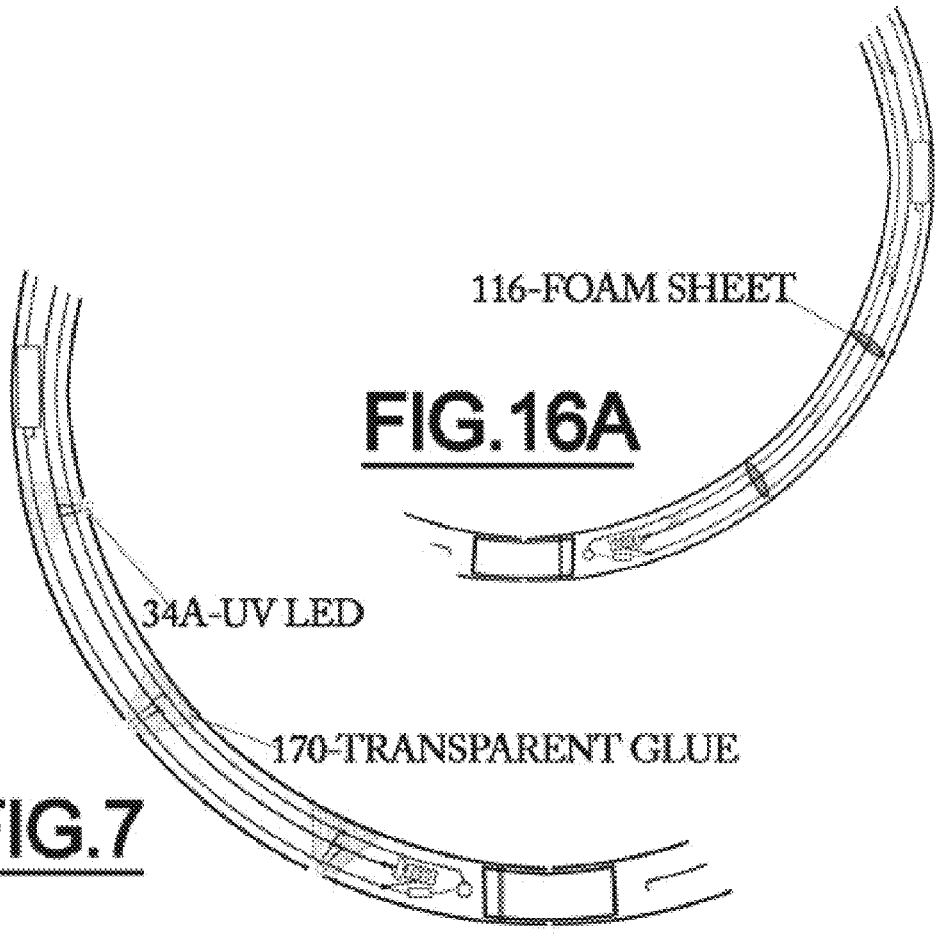
FIG.16A
FIG.7
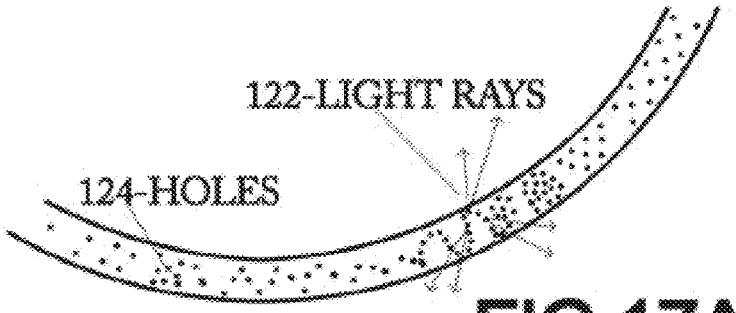
FIG.17A

FIG15.B

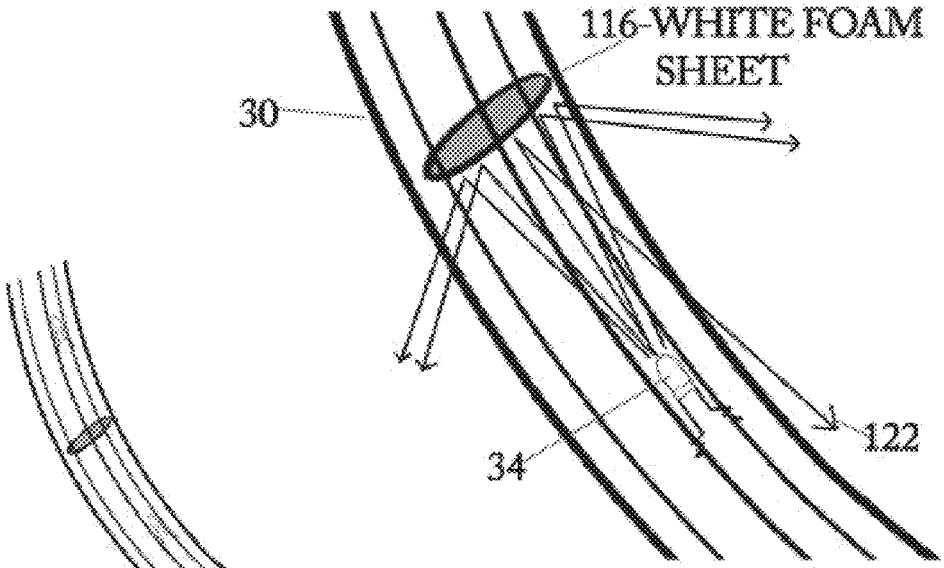
FIG.17D
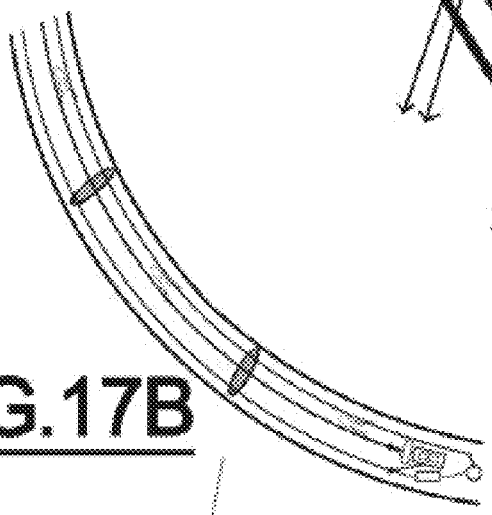
FIG.17B
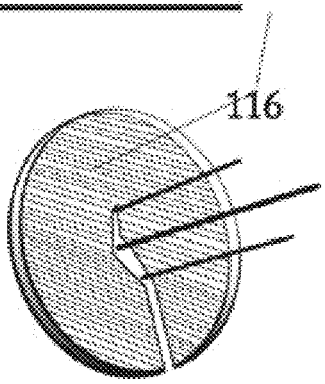
FIG.17C
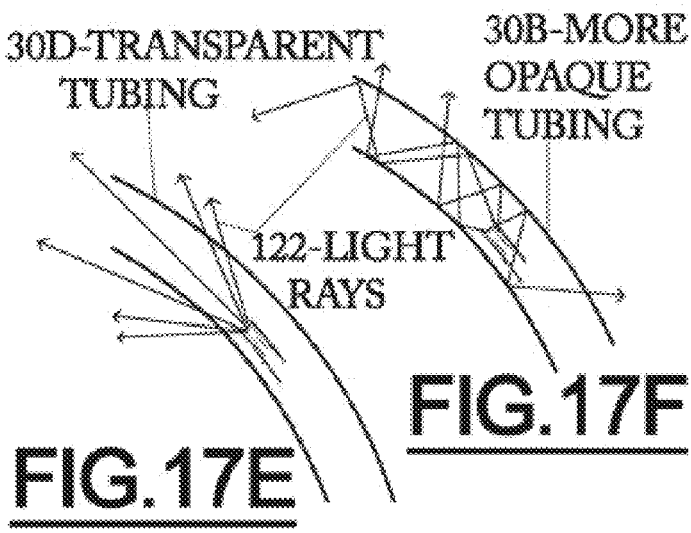
FIG.17E
FIG.17F

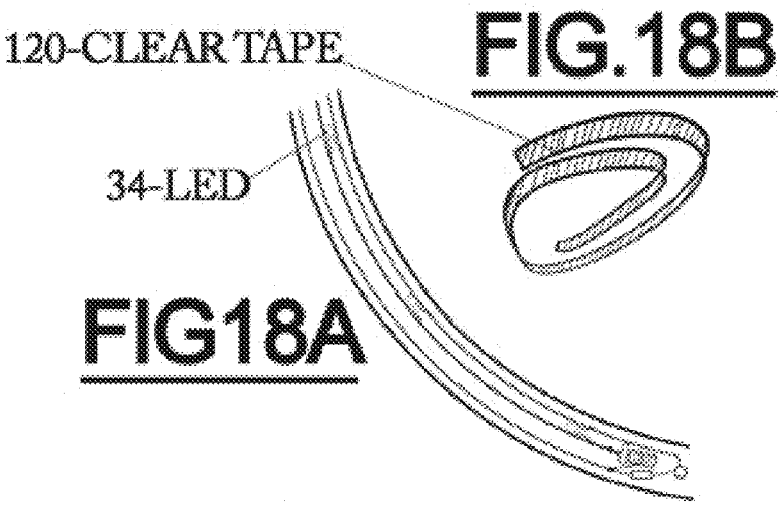
FIG.18B
FIG18A
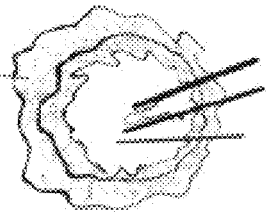
FIG18C
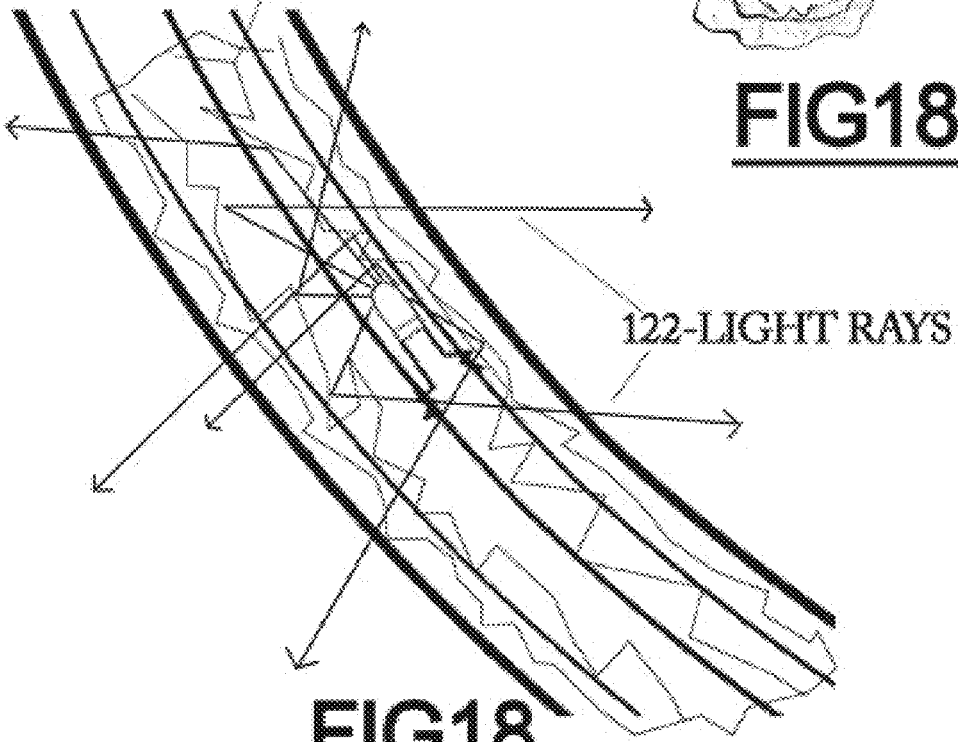
FIG18

134-USER

136-SHAPES
OF TRAILS

USE OF WHEEL MOVE AS A PROGRAM SELECTION

INTERACTIVE SYNTHESIZER HOOP INSTRUMENT

CROSS-REFERENCE TO RELATED APPLICATIONS

This application claims the benefit of PPA Appl. No. 60/648,907, filed Feb. 1, 2005, and patent application Ser. No. 11/343,416 filed on Jan. 31, 2006, and which issued on Jan. 1, 2013 as U.S. Pat. No. 8,342,901.

BACKGROUND OF THE INVENTION

This invention relates to a programmable hoop, and particularly with regard to hoops, electronic instruments, light synthesizers, computer based synthesizers, and LED displays.

Past hoops have been promoted and designed as a toy, e.g. "Hula Hoop®," or piece of exercise equipment. This somewhat limits the use of the hoop to playgrounds or gyms, with the emphasis on smaller-sized hoops and their use as toys.

Previous lighted hula hoops relied on electric bulbs or single colored low output LEDs. For example, a series of light bulbs inside the hoop.

In order for the hoop to truly function as a light and sound instrument, it needs to respond in real time to all the movements the hoop is making. The sensitivity of the response needs to be adjustable, as does the program that interprets a given signal to produce a certain response. Some sensors now have the size, sensitivity and low cost necessary to make this viable. In order to extrapolate the position of all the lights sources at any given time, the pathway of the hoop needs to be understood in three dimensions.

SUMMARY

One embodiment includes a hoop, the hoop including one or more light emitting diodes, motion detection means which will detect changes in motion of said hoop, and a signal from said motion detection means, One embodiment includes a method for altering light emission from a hoop based on movement comprising providing a hoop, providing one or more light emitting diodes, arranging said light emitting diodes inside of or on said hoop, providing light emitted from said light emitting diodes, providing a motion detection means which will detect changes in motion of said hoop, providing a signal from said motion detection means, altering said light from said light emitting diodes based on said signal from said motion detection means, whereby said light from said light emitting diodes will change based on movement of said hoop.

In one embodiment, altering said light from said light emitting diodes is based on said signal from said motion detection means, whereby said light from said light emitting diodes will change based on movement of said hoop.

One embodiment includes the display shift when doing an isolation (turning the hoop like a steering wheel so its imaginary center stays in the same place), but dependent on that would be to have the display shift in such a way as to cause the display/hoop to appear to not be turning. (in several displays the lights are sequencing around the hoop in either direction and as you turn the hoop the speed of the sequence matches your turn so that the lights appear stationary)

Other embodiments include allowing a user to change display based on movement of the hoop, changing the speed of rapid color changes (strobing) based on accelerometer movement, changing the speed of rapid color changes (strobing) so that strobing goes slower when there is more accelerometer movement, changing the speed of rapid color changes (strobing) so that strobing goes slower when there is more accelerometer movement to create a light that looks almost white when at rest, but breaks into colors in an enhanced way when moving, flipping a hoop over to change some element of the display, flipping a hoop over to change many display elements to thereby show a new display pattern, flipping the hoop over to keep the same general pattern and effect, while switching only the colors used, flipping the hoop over to keep the same color used, while changing the general pattern and effect, using the double flip/turn move as a signal to the hoop, detecting isolations and having the display change in response, detecting hooping and having the display change in response, detecting isolations and having the display start to shift/sequence, detecting isolations and having the display start to shift/sequence at a different speed Another embodiment includes detecting isolations and having the display start to shift/sequence at a different speed to make the display/hoop appear to be fixed in space even though the hoop is being turned around Other embodiments include detecting isolations and having the display start to shift/sequence at a different speed to make parts of the display/hoop appear to be fixed in space even though the hoop is being turned around, while other parts continue to move at a different speed, matching elements of the display to hooping speed, matching elements of the display to isolation speed, matching the speed of a color pattern traveling around the hoop to isolation speed, matching the speed of a color pattern traveling around the hoop to hooping speed, matching the speed of a color pattern traveling around the hoop to hooping speed, changing elements of the display based on the movement speed of the hoop, increasing the speed of display elements when hoop speed is increased Increasing the speed of elements that travel around the hoop when hoop speed is increased, increasing the speed of fading colors when hoop speed is increased, using a movement of a hula hoop to save current settings for later use, using a movement of a hula hoop to select a new display for the hoop, using a movement of a hula hoop to select a new set of displays for the hoop, where the user can then use a further movement of the hoop to switch been displays within that set, tapping the hoop to set the speed of a sequence of color moving around a hoop, tapping the hoop to set the speed of fading colors displayed in the hoop, tapping the hoop to set the speed of brightness changing in the hoop, tapping the hoop to set a rhythm of a beat, displayed by sudden changes in the hoop display every beat, tapping the hoop to cause a major display change when tapped, tapping the hoop to cause a burst of color to appear in the hoop when tapped, moving the hoop very fast to cause a major display change, moving the hoop very fast to cause a burst of color to appear, mapping x, y, z activity to hoop properties, for example, such as where color where x, y, z map to r g b, where negative axes map to other color combinations, where axes map to one or more display properties such as segments, speed, LEDs lit, effect type etc

BRIEF DESCRIPTION OF THE FIGURES

FIG. 7 shows a plan view of a section of a UV LED hoop.

FIGS. 15A, 15B and 15C show view of EL wire in a hoop.

FIG. 16A shows a section of a hoop with sound reduction system.

FIG. 17A shows a plan view of a section of a hoop with holes in it.

FIGS. 17B to 17F show detailed views of light reflection/refraction systems.

FIGS. 18, 18A, 18*b* and 18C show more detail views of a light refraction system.

FIGS. 21A to 21C, 22A to 22C and 23A to 23D show plan views of trail shapes left by a lighted hoop.

DETAILED DESCRIPTION

Figure 1A:
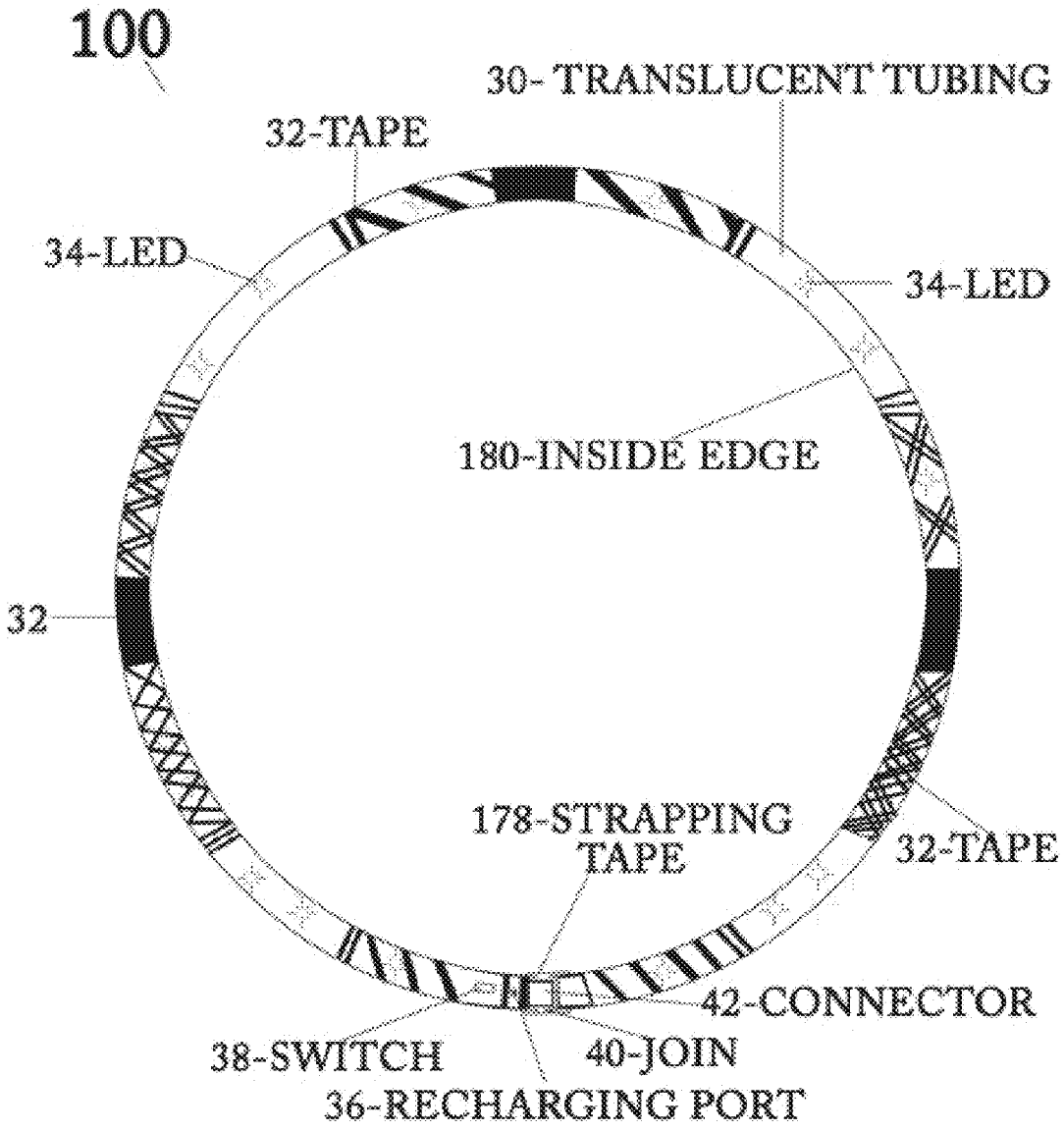
FIG. 1A shows a plan view of an assembled hoop.
Figure 1B:
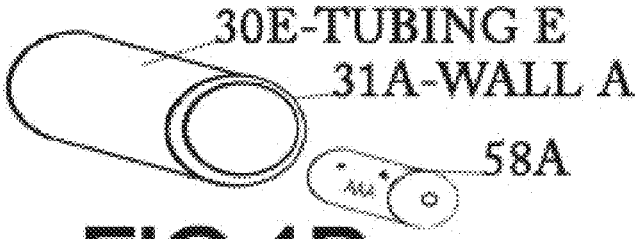
FIG. 1B shows a perspective view of the cross section of the tubing of a small hoop.
Figure 1D:
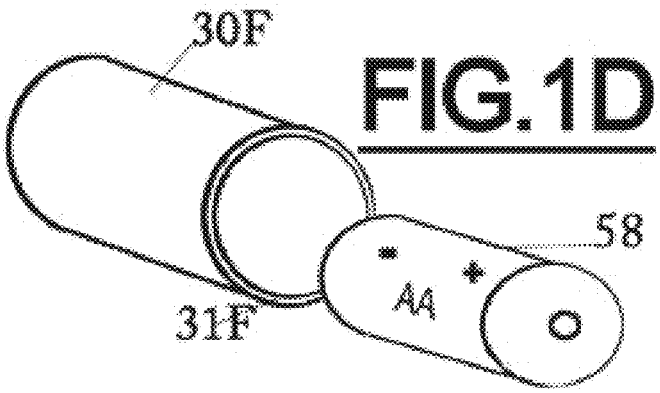
FIGS. 1D, 1E and 1F show perspective views of the cross section of different sized tubings.

The outside of one embodiment of the invention is shown in FIG. 1A-1F. A hoop 100 is shown, the hoop 100 comprising translucent tubing 30, tape 32, LED lights 34, inside edge 180, strapping tape 178, connector 42, switch 38, charging port 36, and joint point 40. In one embodiment the hoop is taped 32. The adhesive tape most commonly is from 0.159 cm (1/16 inch) to 5 cm (2 inches) in width. The tape can be cloth tape and can have varying degrees of translucency, as well as metallic tape and holographic or laser tape.

The hoop is constructed from tubing 30. The tubing can be made from translucent plastic. The plastic can be polypropylene, though it can also be made from co-polymers, terpolymers and polycarbonate, low density polyethylene (LDPE) or high density polyethylene (HDPE) or any plastic material that has similar properties of translucency and flexibility and durability—the plastic needs to be as responsive and lightweight as possible but not to crack or kink. It also needs to be somewhat translucent, though the wall of the tube acts to disperse light, so complete transparency is not ideal.

The tubing for the hoop instrument is selected for its physical properties as well as its translucency. The hoop can be made from polyethylene, but the LDPE (low density polyethylene) creates a sluggish movement at times, and the HDPE makes things bounce a bit too much and is hard on the body. The polyethylene has a certain opaque quality that makes the tubing light up in an interesting way, without the small focus of light that a clear tube produces. The LDPE tubing is ideal for smaller hoops of 33 cm (13 inches) to 56 cm (22 inches) which are used specifically to spin around the arms, hands or legs, or as juggling hoops. The LDPE tubing is also good for smaller children's hoops of 76 cm (30 inch) to 91 cm (36 inch) diameter where flexibility of the tubing is a bonus in terms of prevention of injury from constant rotation on the body or impact with a spinning hoop. Small hoops from 0.559 meters (22 inches) to 0.99 meters (39 inches) in diameter are also well made from smaller diameter polypropylene tubing.). The outside diameter (OD) of the tubing is 1.905 cm (3/4 inch). The wall thickness 31 (FIG. 30) is best at around 0.15875 cm (1/16 inch).

An embodiment of this hoop instrument is made from polypropylene tubing. A mid-sized hoop can be made with diameters ranging from 0.9144 meters (36 inches) to 1.1176 meters (44 inches). These work best with wall thickness of around 0.238 cm (0.09375 inches). The OD of the tubing is 2.54 cm (1 inch). This material and wall thickness gives a hoop that is light enough to be responsive and of sufficient weight to have the needed momentum to follow certain pathways—required in the performance of certain tricks and maneuvers.

The polypropylene tubing is more translucent than the polyethylene material. In order to take advantage of that, the lights are wrapped (FIG. 18C) in iridescent or clear tape 120 (FIG. 18B), which is then crinkled up 120A (FIG. 18). This generates diffraction of the light rays 122, and adds depth to the light n the tubing, making it appear like a crystal instead of an empty tube. The diffraction of light from this crinkled tape also adds to the intensity and quality of the light emitted from the hoop.

Figure 1E:
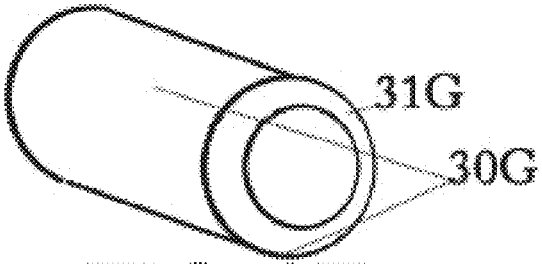
Figure 1F:
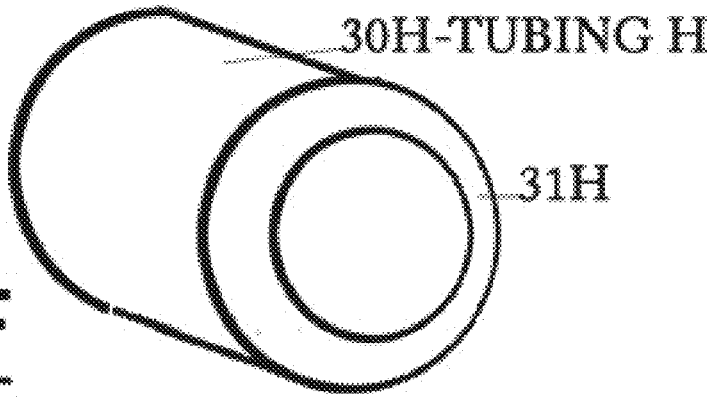

If more stiffness is desired, a wall thickness of 0.3175 cm (1/8 inch) is used (FIG. 1E). This diameter hoop, 0.9144 meters (36 inches) to 1.1176 meters (44 inches), can also be made with a tubing OD of 3.175 cm (1.25 inches), and the same wall thickness. This gives more surface area and so more traction, and a different feel to the hoop, more suitable to a larger or thicker frame body. The hoop is heavier and responds differently. The thicker wall gives it some extra strength and durability under extreme conditions.

The wall thickness of the polypropylene depends on the diameter of the tubing, the overall diameter of the hoop, and the characteristics of flexibility that are required for a particular hoop. One example smaller hoop includes a hoop from 0.559 meters (22 inches) to 0.99 meters (39 inches) in diameter. The wall thickness 31 (FIG. 30) at around 0.15875 cm (1/16 inch). The overall outside diameter (OD) of the tubing is about 1.905 cm (¾ inch).

Example mid-sized hoops can be made with diameters ranging from 0.9144 meters (36 inches) to 1.1176 meters (44 inches). These can work best with wall thickness of around 0.238 cm (0.09375 inches). The OD of the tubing is 2.54 cm (1 inch). If more stiffness is desired a wall thickness of 0.3175 cm (⅛ inch) can be used. This size can also be made with a tubing OD of 3.175 cm (1.25 inches), and the same wall thickness. Large hoops can be made with overall diameters between 1.016 meters (40 inches) and 1.3716 meters (54 inches) and require a wall thickness of 013175 cm (⅛ inch) and an OD of 2.54 cm (finch) or 3.175 cm (1.25 inches). The tube can be bought in rolls, cut to the desired length, and if necessary formed to a circle of the required diameter.

Figure 5:
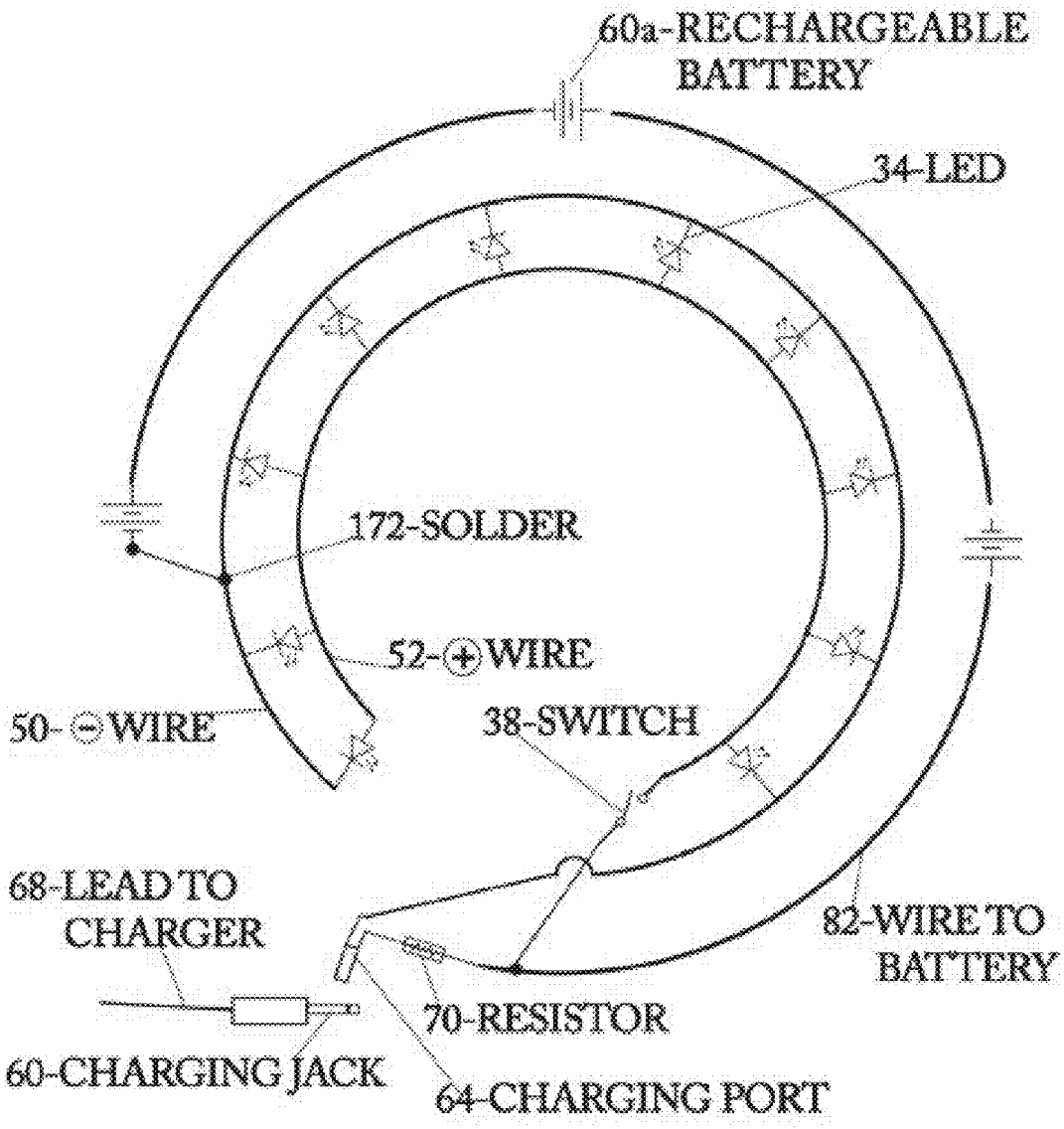
FIG. 5 shows an electronic schematic of a circuit for a rechargeable hoop.

Light emitting diodes (LEDs) 34 are placed inside the hoop at varying intervals (5 to 50 cm). These diodes (FIG. 6) can be of one color 34D or 3 Colors (RGB). They can also have an integrated circuit inside them 34C. The LEDs are soldered 172 (FIG. 6A) to wires 50, 52, 62. In one example, a wire 82 to the battery, goes through a resistor 70 (FIG. 5, FIG. 6A) on a circuit for a charging port 64. This can connect to a charging jack 66. A switch 38 is placed on the circuit to the LEDs. In the case of one circuit, as in FIG. 5, a supporting wire 62 also functions as the positive wire. The supporting wire 62 can be made from 16 or 18-gauge tinned copper. 2 circuits (FIG. 6,6A) require another switch 38A and another wire 52.

Figures 8A, 8B:
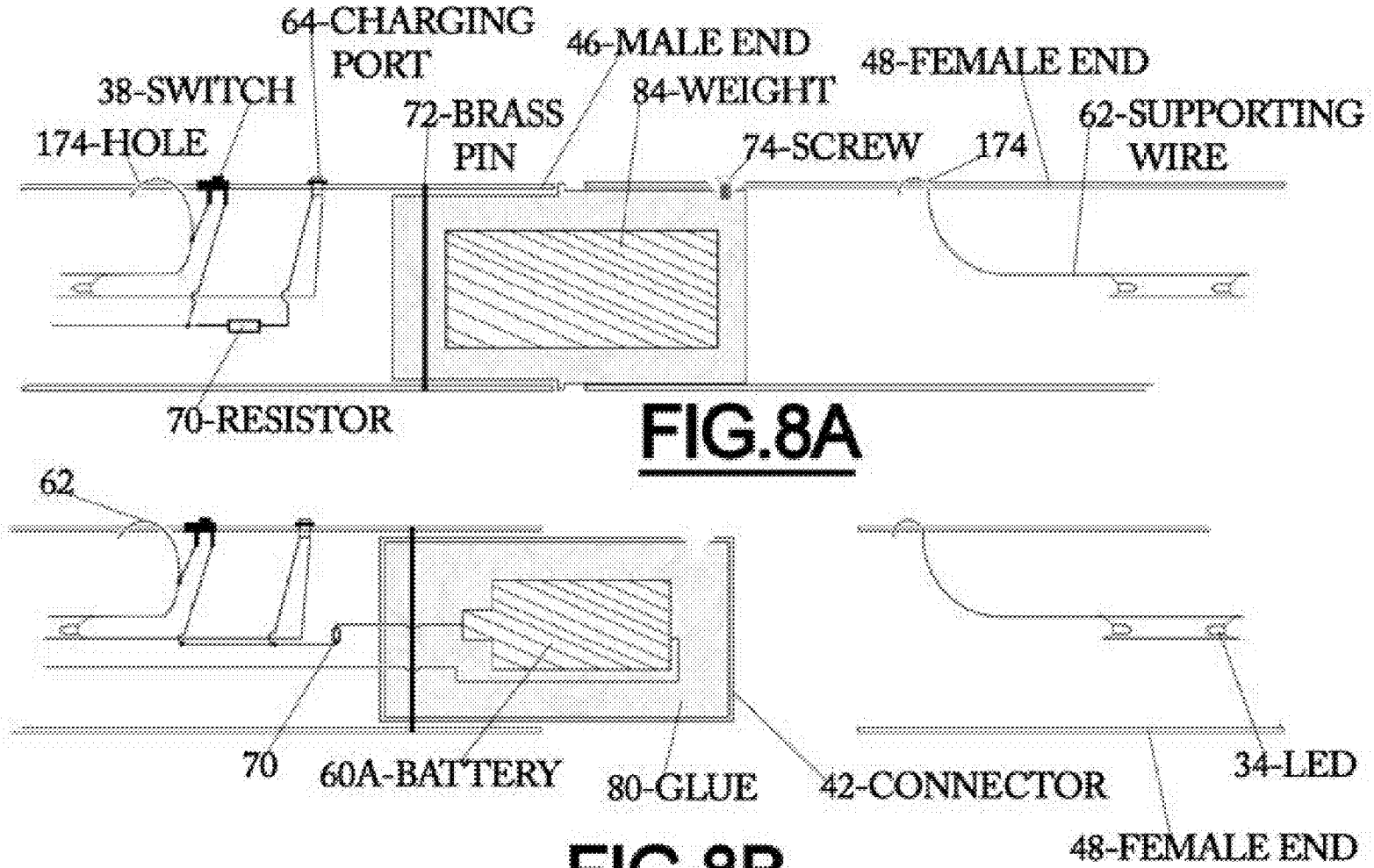
FIGS. 8A and 8B show side views of connectors for the hoop.

Three AA batteries can give enough power for most purposes. In this case the connector 42 is filled with a weight 84 to balance the other batteries 60A around the hoop. The weight 84 is held in place with glue 80. If the hoop needs to be made lighter, one of the batteries can be placed in the connector (FIG. 8B). Or if 4 batteries are needed, to give more power and light intensity, the fourth battery can be placed in the connector (FIG. 8B). With the smaller diameter tubing (OD 1.905 cm) (FIG. 1A, 1B), AAA batteries are used in place of the AAs. Other types of batteries of different voltages can also be used as needed.

A rechargeable battery 60A (FIG. 6A) can soldered in place and held by electrical tape 166. The battery 60A is held in place inside the tube by the injection of hot glue through a hole 168 which is drilled through the wall of the tubing 31. The LED 34C is further stabilized and insulated with hot transparent glue 170. The supporting wire 62 also functions to pull the assembled LEDs, batteries and wires through the tubing before gluing. The supporting wire (FIG. 8A) 62 is threaded through holes drilled in the tubing 174 and held in place by heat welding.

A connector 42 (FIG. 8A) is tooled from PEX tubing or other strong and fairly rigid plastic tubing. A length of 6.5 cm (2.5 inches) is sufficient to provide enough rigidity without distorting the curve of the hoop. The connector 42 is worked on a lathe so that it just fits the female end 48 of the tubing. The other end of the connector is left larger so that it fits permanently onto the male end of the tubing 46. The tubing is heated to allow it the connector 42 to be inserted. A brass pin 72 can be used to hold that side of the connector in place. A screw 74 is used on the female end of the connector to hold that end in place, in cases of extreme and prolonged use of the hoop.

Figure 29A:
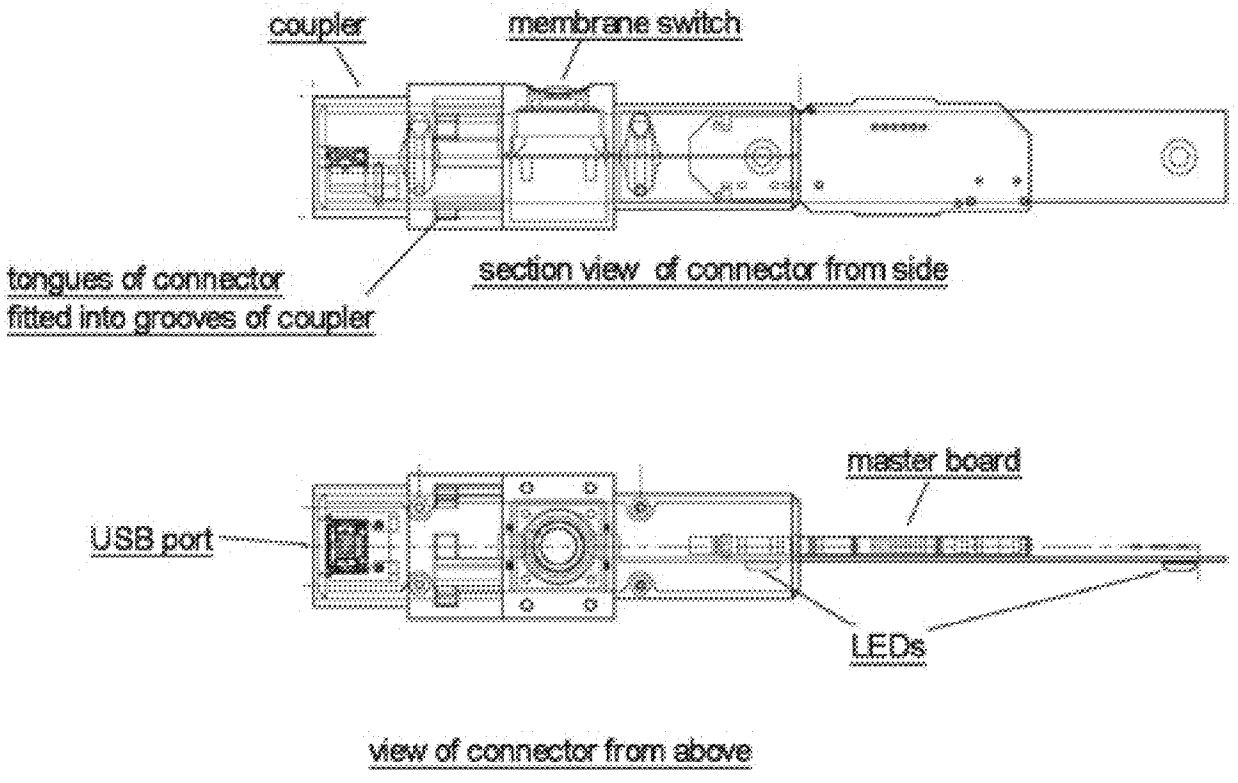
FIGS. 29A and 29B show additional examples of connector portions of an exemplary hoop system.
Figure 29B:
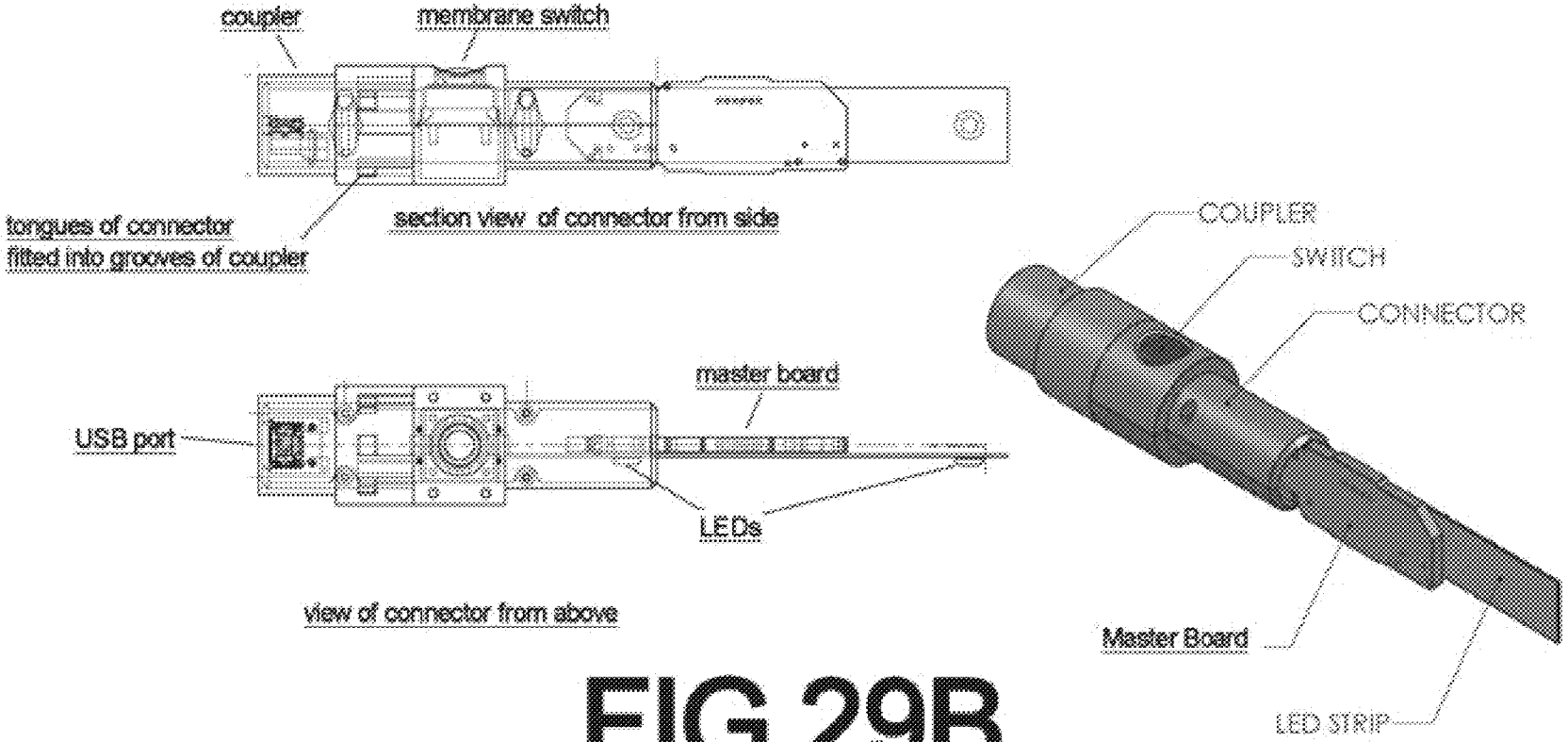

In one embodiment, as shown in FIGS. 29A and 29B, the connector is made in a mold and holds the master board in a certain alignment, and also supports the internal USB port that allows connection to a computer for downloading programs and for charging the hoop. The method of attachment for the two ends of the tubing utilizes a three set tongue and groove arrangement with the connector and a separate coupler.

Figure 11A:
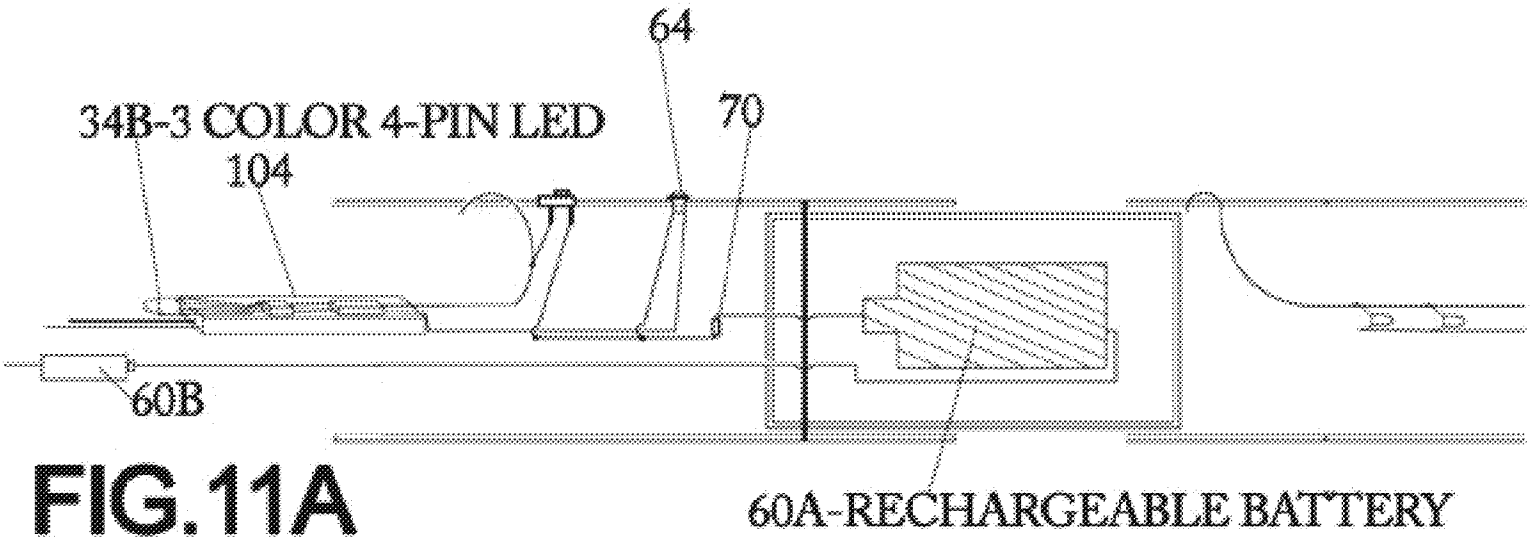
FIGS. 11A and 11B show side and perspective views of an electronic sensor.

The hoop instrument can be turned on with a sliding switch 38 (FIG. 11A) that is recessed so it doesn't accidentally get turned off or on during use. The switch is placed on the top side of the hoop, as seen in FIG. 1, as opposed to the inside or outside edges of the hoop, so that it doesn't get rubbed by the user's body or clothes, or by the floor if it is rolled or spun on the floor. The top side of the hoop is dependent on orientation of the PSI-hoop and is not a permanent location.

Having switches that respond to acceleration, motion, impact and so forth, adds a lot more variety to the lighting effects and synchronizes the range, speed and type of movement of the hoop with the light colors and patterns and with the sounds generated. This adds to the performance and invites the performer to exercise for longer periods. The way the colors vary with the speed and actions of the performer gives much more information about the movements of the hoop to both performer and audience. This information can be used by the performer as a direct reflection of their movement and intentions, rather like a biofeedback device, and allows for a rapid gain in proficiency with the hoop, so this really does function as an instructive device.

Figure 11B:
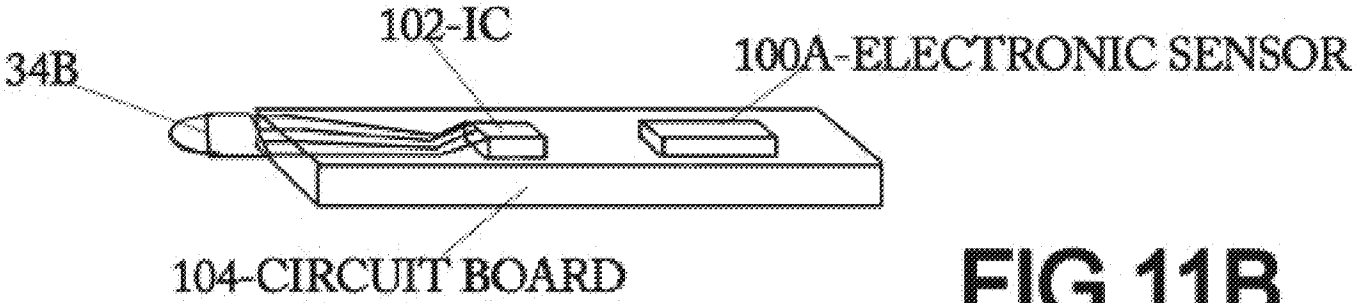

The interactive hoop instrument has one or more electronic sensors 100 (FIG. 11B) on board. One example uses a type of sensor known as an accelerometer. The accelerometer measures vector changes along 3 axes and outputs a signal depending on the movement of the hoop. When the switch 64 is on, and the hoop is picked up or moved, the sensor detects the movement and activates the LEDs. To increase the speed of response of the instrument, more than one sensor can be used, In this case they are distributed evenly around the hoop. Each sensor can communicate with its own set of LEDs or sections of EL wire, and also send signals to the processor nearest the switch and radio transmitter/receiver. This option increases the cost of production, but also increases the sensitivity and responsiveness of the synthesizer hoopother.

Figure 9A:
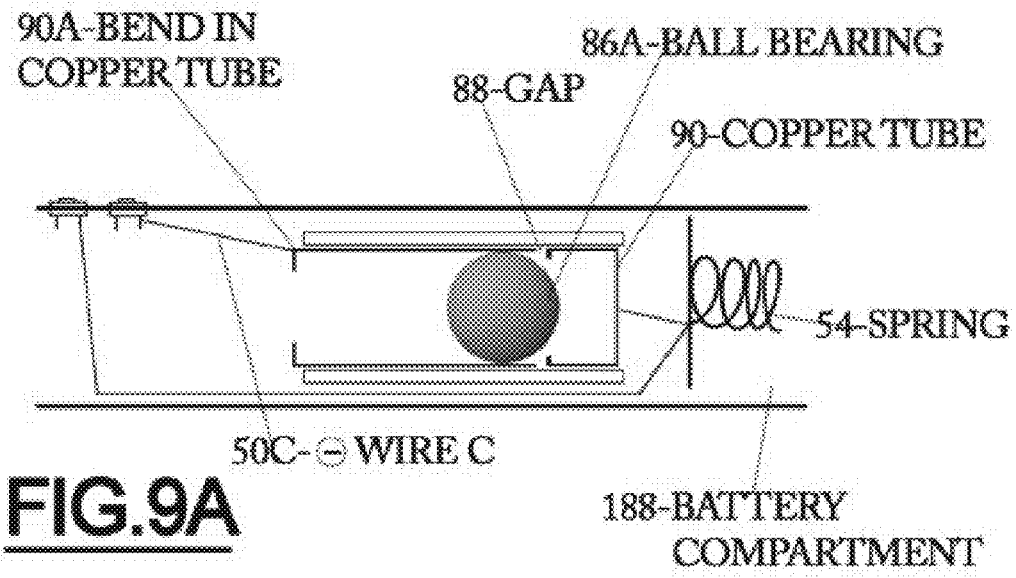
FIGS. 9A and 9B show side views of electromechanical switches.

An electromechanical sensor 176 (FIG. 6A) can be placed in the circuit. These sensor/switches range from simple mechanical ones, as in (FIG. 9A, 9B) to more complex ones as in FIG. 10 A, B and C, and to electronic ones as in FIGS. 11A and 11B. They create different patterns of lights and are all of use in variations of the preferred embodiment of this interactive hoop instrument. FIG. 10 shows one example of a switch used to activate the lights based on hoop movement. In FIG. 10 A (side view), 10 B (cross section) and 10C (detailed side view), a ball bearing 86 is placed within a tube 92B which is of slightly larger diameter than the ball bearing. On the inside of this tube are four copper rods 98. The copper rods are bent (FIG. 10C) and held in place inside another plastic tube 92A. As the hoop moves, the ball bearing moves inside the tube and makes an electrical contact between pairs of the copper rods. The switch 38 provides a way to bypass this circuit.

An electronic sensor (FIG. 11A, 11B) of a type known as a 3-axis accelerometer 100 is used in one embodiment of this instrument. The accelerometer can be mounted on a circuit board 104 and connected through an IC 102 to a 3 color 4 pin LED 34B. The hoop has a plurality of circuit boards 104 with ICs 102 and attached LEDs (FIG. 12), connected by cable or wire. More than one sensor can be used, usually 2 or 3, in which case they are distributed at equal distances around the hoop.

In another embodiment of this interactive hoop instrument, (FIG. 28A) a radio transmitter 140 is placed in the hoop connected to the electronic sensor 100. External to the hoop there is an antenna 144 and a wireless receiver 142 connected by a cable 146 to a computer 148. The computer is connected to speakers 152.

The hoop can have a charging port, for example as shown at element 64 (FIG. 8A). The battery circuit is connected to this with a resistor 70 that is of appropriate Ohms to allow the charger to trickle charge the batteries safely. NiH rechargeable batteries can be used because they are more environmentally sound and don't have a 'memory' effect, so they can be charged even if not fully discharged. The batteries 60A (FIG. 6) are placed equidistantly around the hoop so that the balance of the hoop is maintained. Three 1.5 Volt batteries are normally used, and a counter weight 84 (FIG. 8A) is inserted in the connector 42 to provide even distribution of weight. If a lighter hoop is required, then the third battery can be placed in the connector (FIG. 8B). If more power is needed, to provide stronger illumination, a fourth battery can go in the connector to replace the weight in FIG. 8A. The idea is to keep the hoop spinning as evenly as possible.

The wires and LEDs can be wrapped (FIGS. 18, 18A and 18B) in clear or iridescent clear tape 120A which is crinkled up enough to fit into the tubing and hold the wires and LEDs in place.

Figure 2:
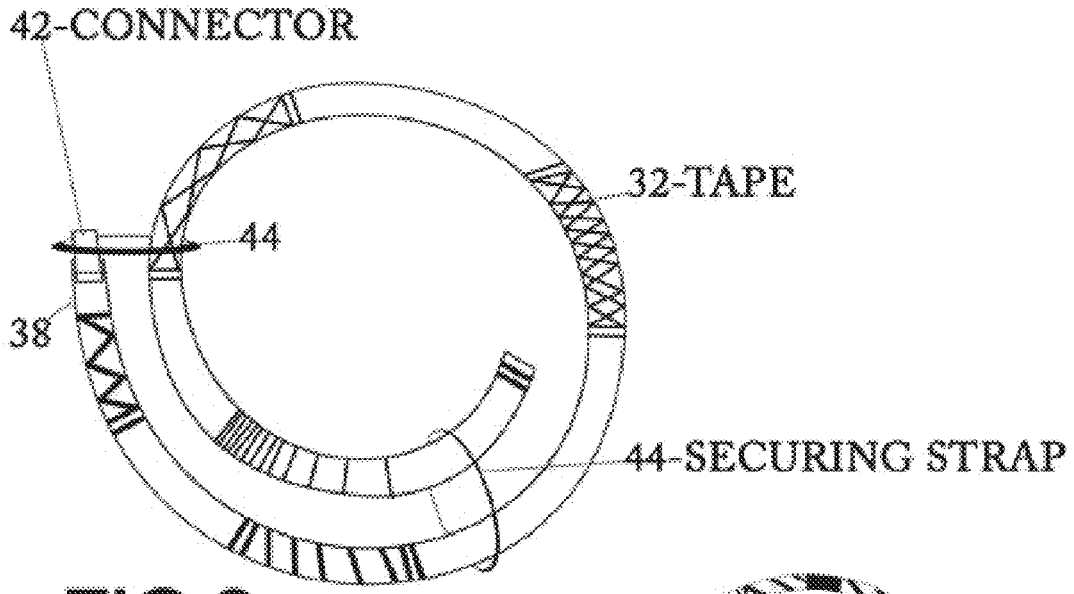
FIG. 2 shows a plan view of a hoop taken apart for travel.
Figure 3A:
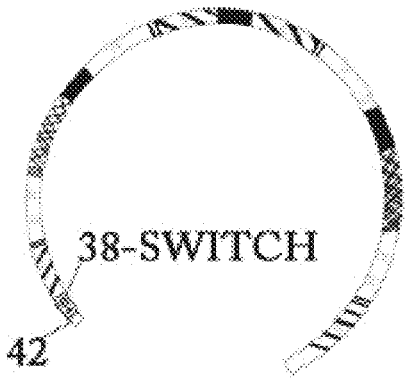
FIGS. 3A and 3B show plan views of a hoop taken apart for use
Figure 3B:
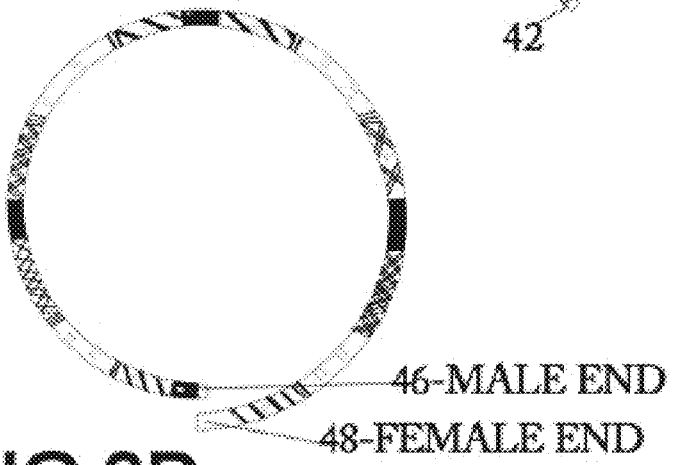
Figure 2A:
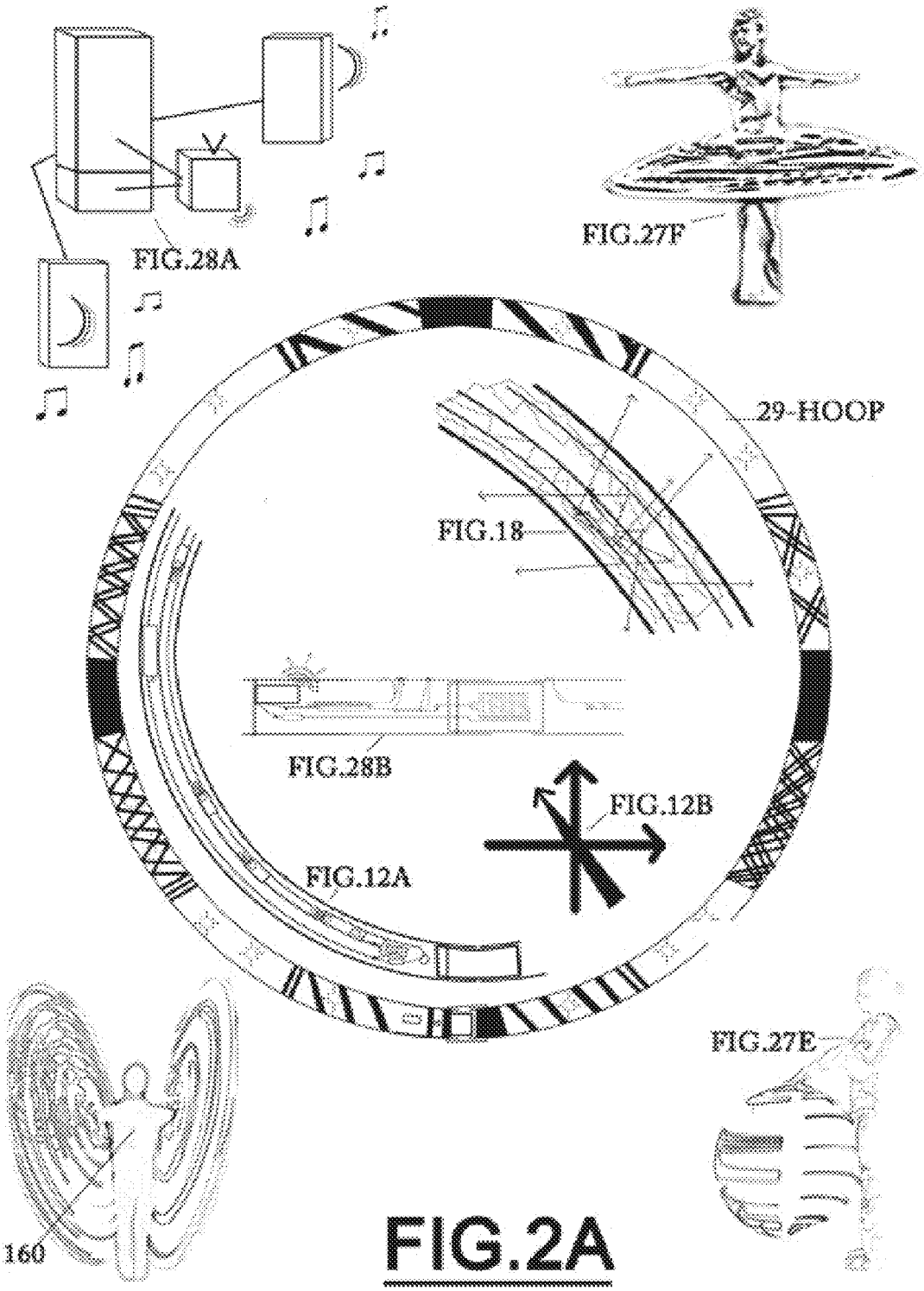
FIG. 2A shows the OG figure, an overview of the interactive hoop instrument.

The wires and LEDs inside the hoop rattle around, make a noise, and weaken the internal connections unless they are held in some way. The clear tape can also function as a sound reduction system (FIGS. 16E and 16F). The tape holds all the components snuggly inside the tube and there is little or no movement of the wires, circuit boards or LEDs. In order to further stabilize the internal parts of the hoop, (FIG. 6A) the batteries 60A are taped 166 around the supporting wire 62, and then after the whole assembly is threaded through the hoop tubing, holes 124A are drilled in the tubing, at the place where the battery is located, and then hot glue 170 is injected into the tubing around the battery to hold it in place, despite the violent movements and impacts the hoop is subjected to. (The hoop can be bounced off the floor or strike other hoops, or change direction suddenly or be subjected to sudden vector changes). The soldered 172 joins of the LEDs to the wire, or of the circuit boards or switches or sensors, are also glued 170 after soldering, to increase their stability and life. Both ends of the supporting wire 62 (FIG. 8A) are threaded through holes 174 drilled in the tubing. This further stabilizes the internal components. The connector 42 is tooled on a lathe to fit exactly on the female end 48 of the tubing, so that the hoop can be taken apart and put together easily but still have snug support without wobbling. The hoop can be taken apart for transport on a plane or to mail the hoop (FIG. 2). For example, it can be held together with a securing strap 44. Gaffers or vinyl tape could also be used to secure the ends of the hoop. When the hoop is in use, a wrapping of strong clear strapping tape 178 or cloth tape 32 is wound around the connection to secure it. The hoop can be used without tape if it is spun and worked gently. This would be the case when the ends are then taken apart during use of the instrument (FIG. 3A, FIG. 3B) so that the tubing can be used more as a skipping rope, or connected to other similar hoops to make shapes that are then moved. For extreme play, to lock the ends together, a screw 74 can be fastened through the tubing and connector. The battery 60A or weight 84 in the connector is held in place with glue. The side of the connector forming the male end of the tubing is tooled so it is thicker and the tubing needs to be heated in order to insert it. As the tubing cools it holds the connector firmly in place. A brass pin 72 is used in the extreme model of this embodiment of the hoop instrument, to lock that side of the connector in place.

It might seem counter-intuitive to tape a lighted hoop, but in practice taping opens up many possibilities for varying the display of trails and colors and shades. The primary function of tape on a hoop is for traction. The inside edge 180 (FIG. 1) of the hoop instrument is sandpapered for this purpose. Cloth tape gives good traction, due to its thickness and rough texture. It is, however, opaque to a large extent and is thus used with care and proper positioning. The hoop is first constructed and assembled. The batteries are then charged. Then, with the lights on, the taping can be accomplished easily, working over the lights with thin strips of opaque tape, or thicker strips of translucent tape, and forming shapes with the tape that will modify the trails in interesting or predictable ways. The secondary function of the tape is for aesthetic appeal, and with this kind of lighted hoop instrument the aesthetics come not just from the looks of the tape but the effects it has on the lights and trails. Many of the patterns produced by this instrument are directly created or modified by the taping on the outside of the hoop. Tape of all widths and degrees of translucency is used. A tape cutter produces the thin strips. If a lot of metallic or laser or holographic tape is used that makes the hoop too slippery, then it can all be covered by rough surfaced but transparent tape, such as strapping tape. The tape also adds weight to the hoop, so in general not too much is used unless the hoop needs extra weight. In general, the thicker the tape and the greater the distance between strips of tape on the surface of the hoop, the longer the trails produced. Thin strips of tape, down to about 0.2 cm produce more intricate variations in the trails. The tape can be adjusted by the user, depending on their preferences, being easily removable. If the hoop is to be used frequently in the daytime or under bright lights, where the visual display is minimized, taping the hoop with laser or holographic or metallic tape can give some more visual interest. Because these kinds of tape are slippery, thin strips of cloth tape can be placed over them at intervals. The whole hoop, or certain parts of it, can then be wrapped in transparent tape that has better friction. If the hoop is to be used under UV lights, then black light sensitive cloth tape gives it color and appeal.

Both the inside and outside of the hoop is taped. The tape on the outside serves to increase traction between the body of the user and the hoop itself. The better the connection between the hoop and the user, the more directly one can play the instrument with the whole body. Where the tape would interfere with the lights, sandpapering the outside of the tubing on its inner curve serves the purpose of increasing traction and grip. The tape on the outside also serves to break up the trails coming from the lights and create more detailed patterns of color and light. This gives the display more resolution. The taping of the hoop adds variety and depth to the trails produced, helping to provide displays that are interesting, beautiful and responsive to the movements of the performer or user. The clear tape on the inside serves to hold the components together and thus to prevent damage to them. It also acts to dampen the extraneous sound from inside the hoop. The sounds the user wants from the hoop are not the wires and LEDs banging around. A further function of this tape is to add depth to the display. FIGS. 18, 18A-C illustrate this. The tape is wound around the internal components and crinkled to provide a multitude of surfaces for light diffraction. The source of light is then diffused without losing any brightness and the tube looks like a crystal filled with light rather than an empty tube. In an instrument designed to provide light and sound, aesthetics are a consideration and contribute to the effects produced. Taping the hoop with varying widths of tape, and varying opacities of the tape, makes different shapes on the hoop and affects the trails and display produced. Transparent holographic, laser or iridescent tape can also be used on the outside of the tubing. The tubing itself could also be created with patterns in it, or with an opalescent effect.

This taping alone, even with simple one color LEDs or EL wire in the hoop, allows the performer to generate a multitude of patterns, by varying speed, direction, and rotation of the hoop. Already, without the addition of any further electronics or computer control, we have an instrument that can reflect the mood and intention of the performer, giving them feedback, and informing them directly as to the quality of their movements, and displaying that interaction to an audience or other hoopsters. The addition of circuits and switches and sensors and wireless, then adds depth and intricacy to this. The further addition of the audio feedback either to the performer alone through wireless headphones with onboard samplers or to an audience through a synthesizer and speakers, then gives even more scope to this instrument as both an entertainment and artistic device.

Because of the careful and calculated construction and alignment and placement of components as set forth herein, each hoop is relatively free of rattle or wobble, and it can withstand impacts and sudden changes of direction etc. The hoop is also balanced in weight all around the tube, with batteries and other components spaced evenly around, so that the spin of the hoop is perfect in all situations. This is not the case with other hoops or toys of similar appearance.

Example Embodiments and Uses

Physically, the manner of using the interactive hoop instrument is similar to the use of any type of hoop, for example, including the popularized Hula-Hoop™. However, the hoop is responsive to much more than just a spinning or rotational movement. The hoop instrument is used both by children and adults, and must withstand the rigors of performance. The hoop can be spun, rotated around any of the limbs, rolled on the ground, thrown in the air, and so on. The hoop can be spun around the ankles, the calves, the knees, the thighs, hips, waist, chest, neck, shoulders, head and face, arms, wrists, hands or fingers—i.e. the whole body can be used to interact with the hoop. The hoop is heavy and large enough to be used by adults of all sizes and shapes. Many of the motions that can be imparted to the hoop are done with the limbs, without the hoop spinning around the body. The hoop can be turned or moved in many ways by the hands in front of the body (or to the side or at the back). The ends can be taken apart (FIG. 3A, 3B), and joined with other hoops. In this configuration it can be used like a jump-rope. Large (4 feet and larger) diameter hoops can be spun around the torso of two people who are inside the hoop at the same time. Much of this is possible with an unlighted hoop that is large and heavy enough and taped properly. But the lights give a reflection of the movements of the hoop. Thus with this lighted hoop instrument it is easier to see what effect one is having on the movement of the hoop at any instant. The feedback from the hoop is visual as well as kinesthetic. And with the sound function turned on the feedback is auditory as well.

The hoop is able to detect its orientation and movement in space. This aspect is used in programming and interacting with the hoop and also is used to vary the displays in real time. Easily recognizable words and symbols and simple pictures can be drawn in the air using these capabilities within the hoop. This is distinguished from other hoops with programmable displays, as such hoops have no interactions with those displays other than the ability to turn the hoop on and off without regard to orientation or position, and to select a preprogrammed display or sequence of displays. Although attractive, these other displays have nothing to do with the orientation or movement of the hoop on its 3 axes. The embodiments described herein allow all aspects of the display and color and pattern and brightness etc of the hoop to be controlled at least through orientation of the hoop and movement of it along any axis. All the various qualities of movement are harnessed to give interaction between the user and the hoop.

Figure 20A:
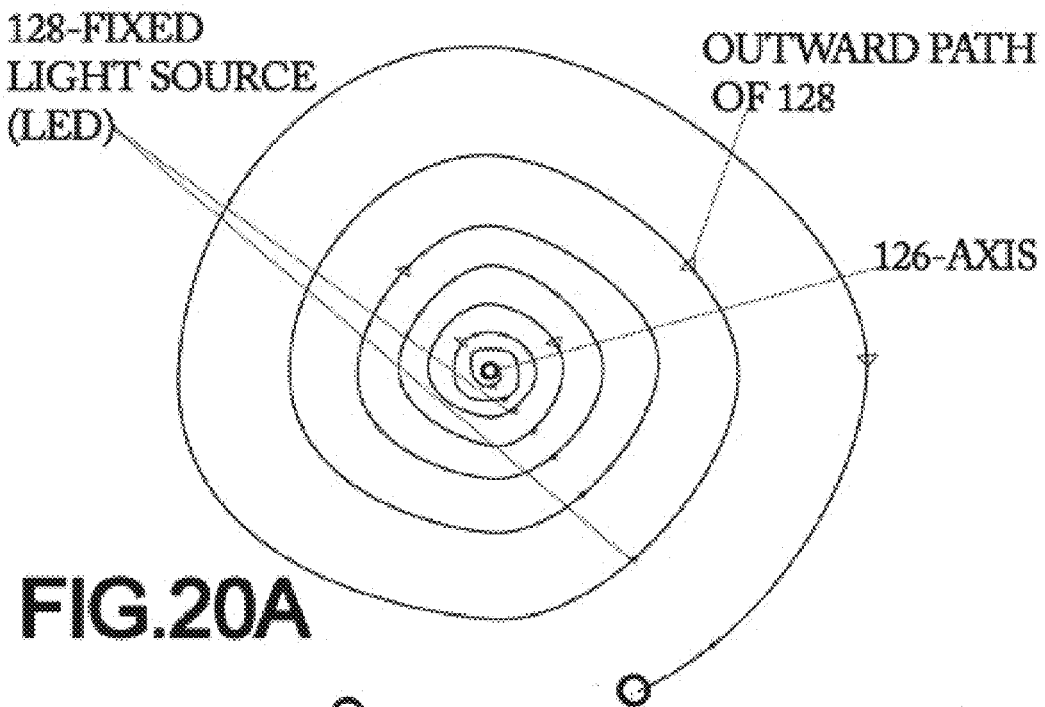
FIGS. 20A and 20B show plan views of the path of a point in a hoop rotating around a wrist.
Figure 20B:
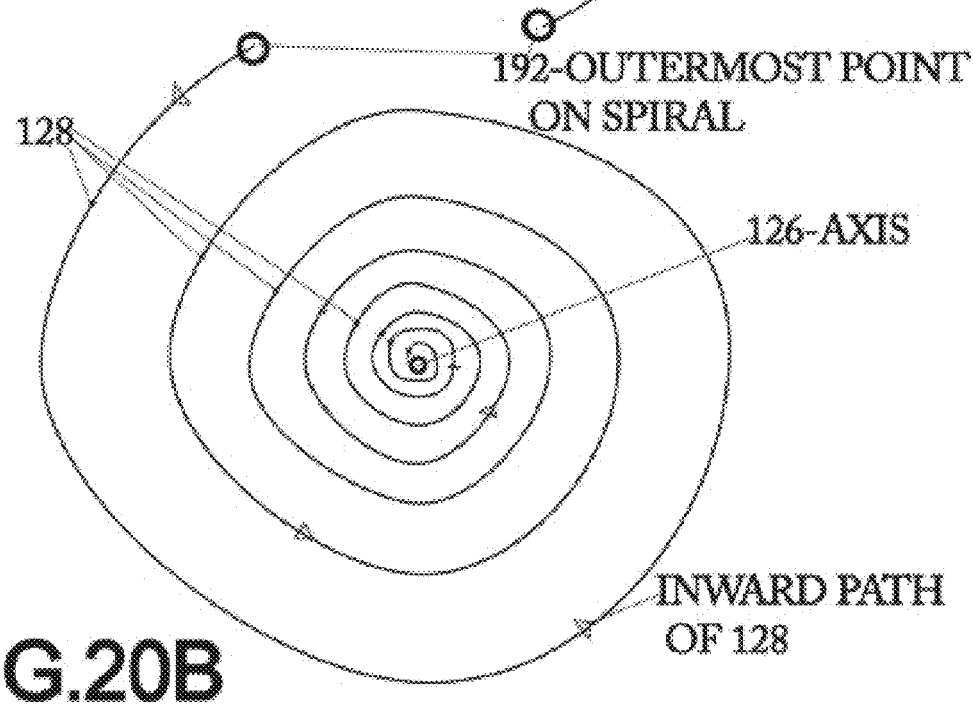
Figure 20C:
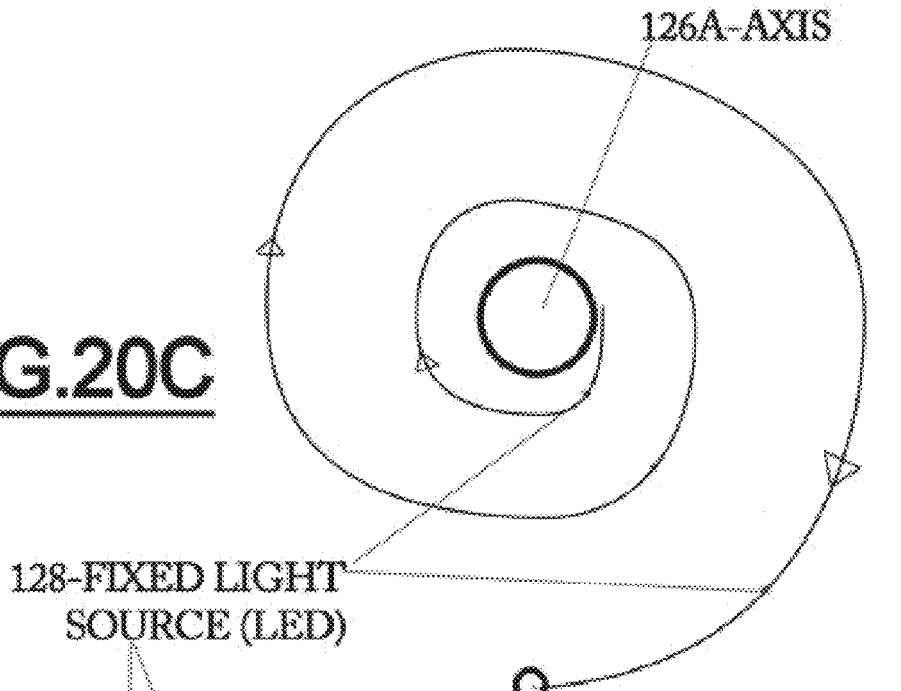
FIGS. 20C and 20D show plan views of the path of a point in a hoop rotating around a waist.
Figure 20D:
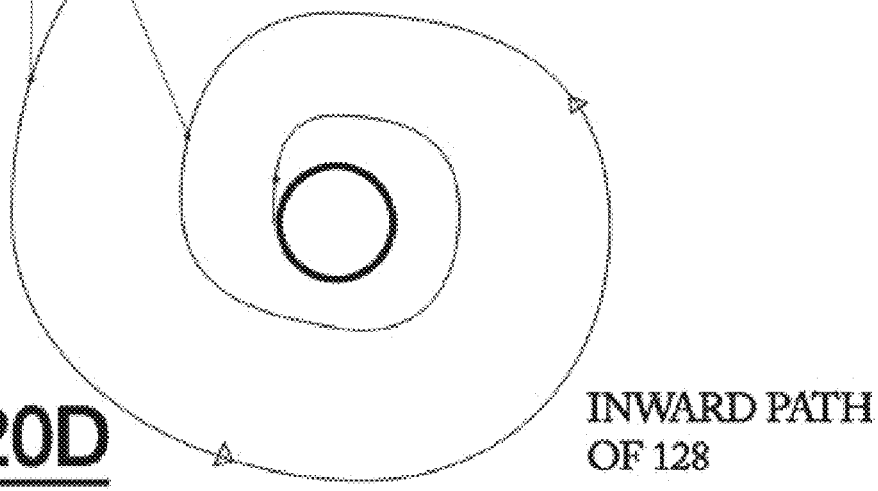
Figures 27A, 27B, 27C, 27D, 27E, 27F, 27G, 27H, 27J:
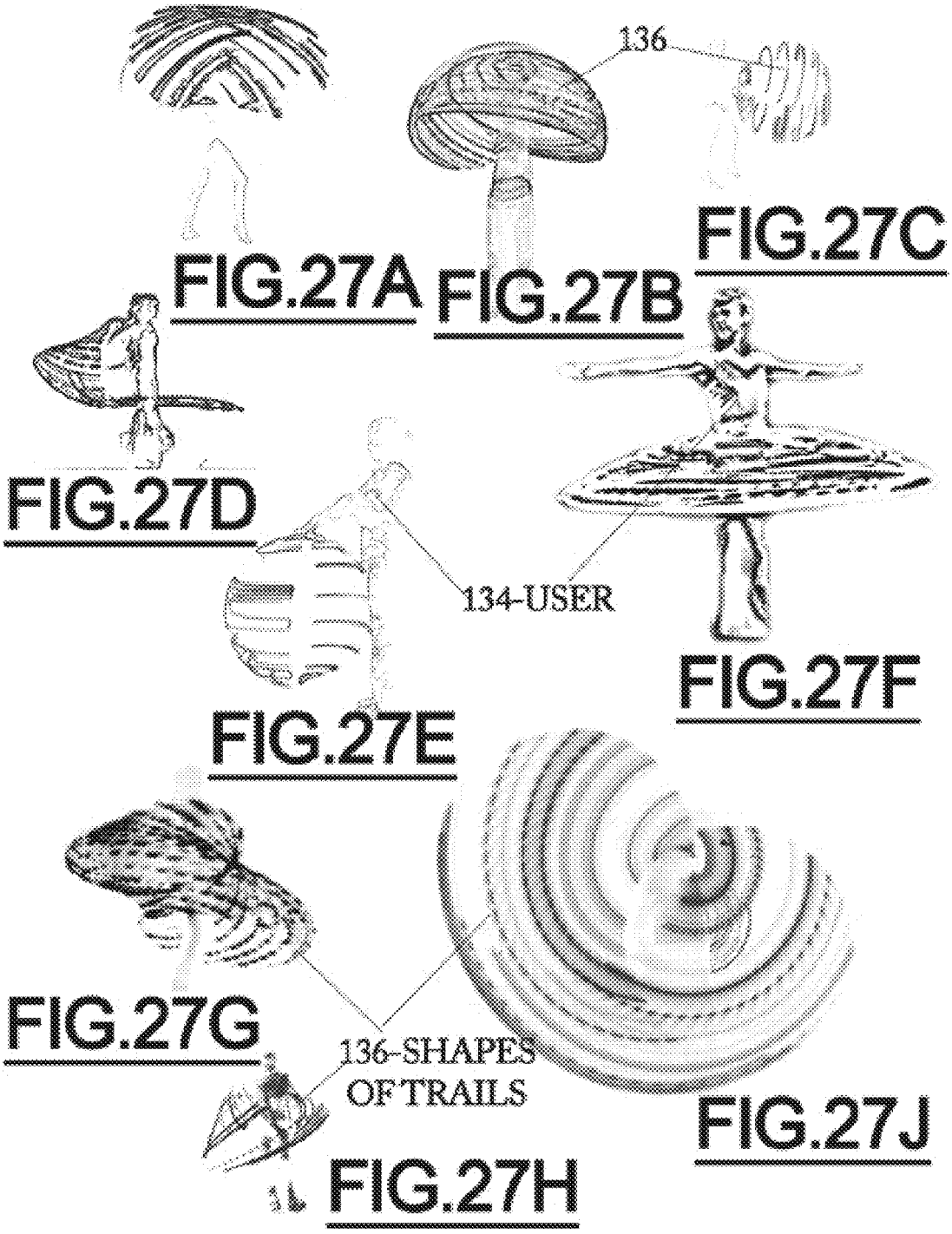
FIGS. 27A to 27H and 27J show views of performers with hoops making different trail patterns and shapes.

In one example, video of a hoop at night with only one LED light lit reveals the pathways that any point on the hoop follows. This is important to know when you are trying to work out how to program, affect or improve the visual display of a hoop, or interpret the data that a sensor is accumulating as to its motion. A spiral path is shown in FIG. 20A. The axis in this case is the wrist, with the hand being held above the head and the video camera looking down from 20 feet straight above the "hoopster". (FIGS. 27A and 27B show 2 hoopsters spinning hoops above their heads in different patterns). You will notice that the light takes 8 or so revolutions to reach its outermost point on the spiral, and then (FIG. 20B) (The path is shown flipped vertically for ease of illustration) it describes a similar spiral on its way back to the axis, in this case the wrist of the performer. This is compared to (FIG. 20C) where the hoop is turning around a wider diameter axis 126A, in this case the waist. Here we see 128 the light only takes two revolutions to reach its outermost point, and then spirals back in two more revolutions. This motion of each point in the hoop is what makes the trails and patterns of lights produced by this invention. It is from these kinds of movement paths that the sensors (Micro-Electro Mechanical Systems—MEMS, or accelerometers or other electronic or electromechanical sensors) output their signals to the LEDs, EL wire, receiver, computer, audio equipment or other hoops and displays.

Figure 24A:
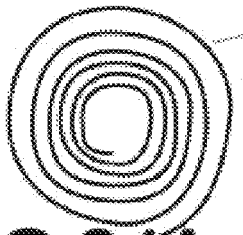
FIGS. 24A to 24F and 25A to 25C show some paths of lights in a moving hoop.
Figure 24D:
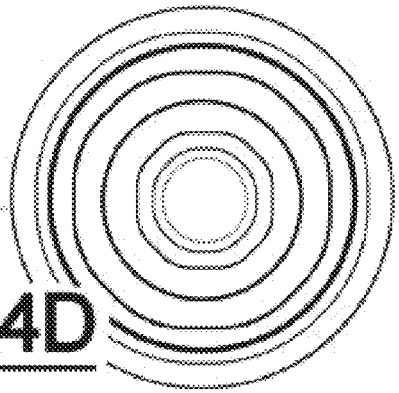
Figure 24B:
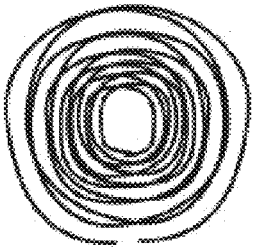
Figure 24E:
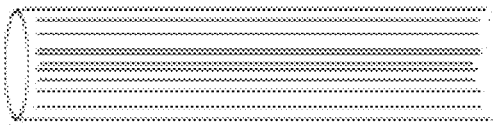
Figure 24C:
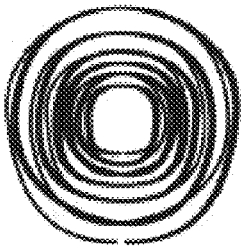
Figure 26A:
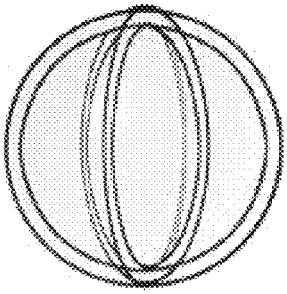
FIGS. 26A and 26B show some shapes that a moving hoop can form.
Figure 26B:
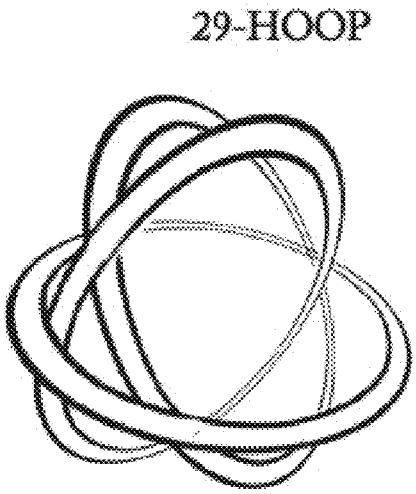
Figure 26C:
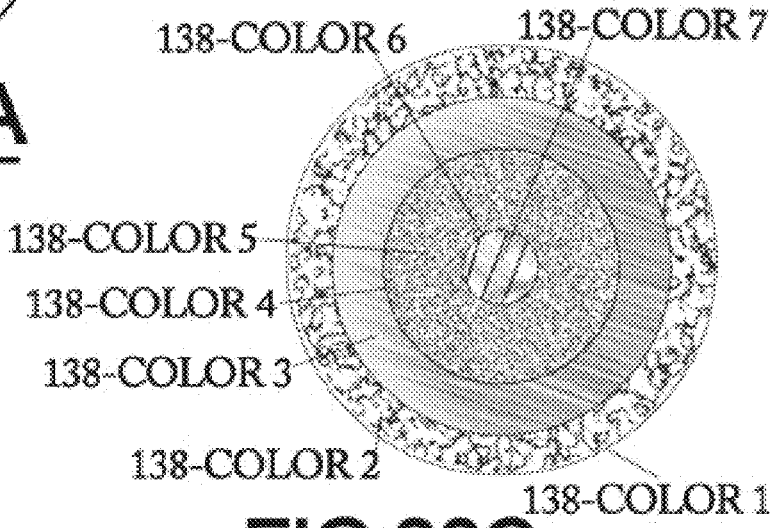
FIG. 26C shows a pattern that a spinning lighted hoop can make.

This spiral (FIGS. 20A-D) forms the basis of the patterns made when a lighted hoop is spun in one plane, either vertically or horizontally or a combination of those. This is seen if the hoop is used in the manner of a "Hula-Hoop" with different parts of the body forming the axis, or when the hoop is spun around the arm, hand or wrist, outside the body. This spiral is further illustrated in FIG. 19B. The axis 126A in this case is the waist or chest of the hoopster. The whole hoop 29 is illustrated here, along with the different points on a spiral 128A-D that a fixed light 128 travels through, on its outward path. This might only take a second, if the hoop is being spun fast. As the hoop continues to spin (FIG. 24A-C), the light spirals in and out and creates the appearance of circles of light (FIG. 24D). With different colored lights in the hoop, patterns appear (FIG. 26C). Furthermore, if the hoop is taped (FIG. 1) complex patterns (FIG. 27J) appear.

Figure 19A:
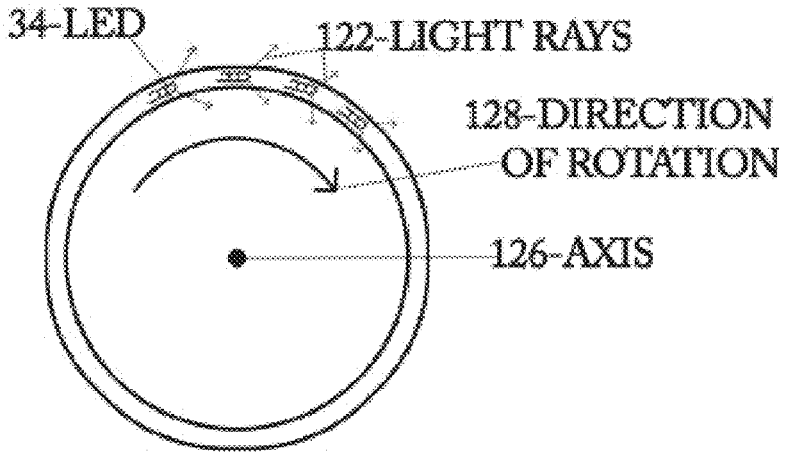
FIGS. 19A and 19B show the path of a point in a hoop.
Figure 21A:
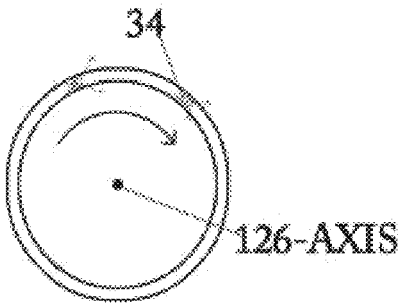
Figure 21B:
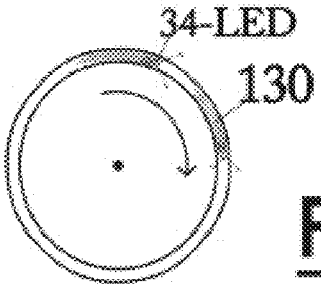
Figure 21C:
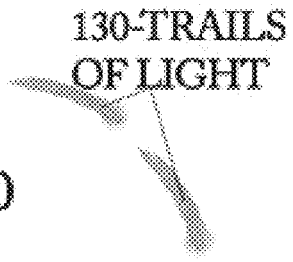
Figure 22A:
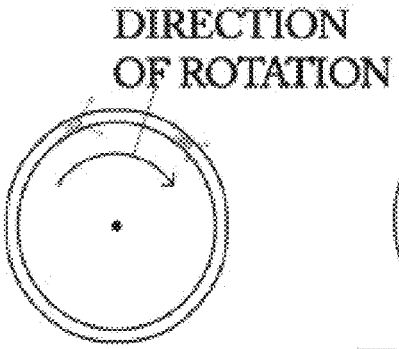
Figure 22B:
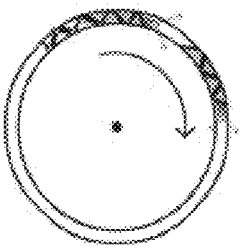
Figure 23C:
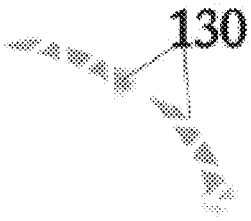
Figure 23C:
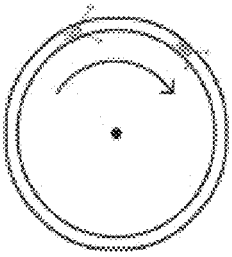
Figure 23C:
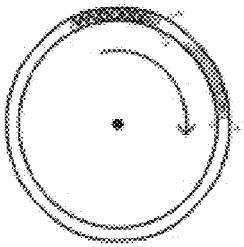
Figure 23C:
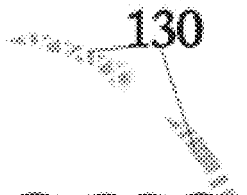
Figure 23D:
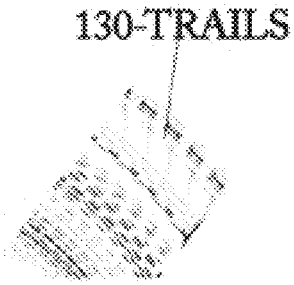

This spiral is not the only pathway of a light source fixed in a hoop. The hoop can be turned around its own axis (FIG. 19A), either in the air, or using the hands outside the body, or spinning the hoop on the ground. This causes the lights 34 to move in the direction of rotation 128 and to leave trails (FIG. 21A-C). The length of the trail is proportional to the speed of rotation. The addition of tape on the surface of the hoop (FIG. 1) creates shapes and patterns of lights (FIGS. 22A-C, FIGS. 23A-C). The trails 130 (FIGS. 23C and 23D) become complex and varied. With the addition of different colors the trails become more interesting. One color mixes with the next one to produce intermediary colors. 3 color LEDs now come with their own mixing, flashing and fading patterns, and by selecting these carefully and arranging them in sequences (FIG. 6) 34C, 34D, 34E a multitude of colors and patterns emerge.

The spiral path of any one point in a hoop is determined by the girth of the axis the hoop is spinning around. The greater the difference in relative size between the diameter of the hoop and the diameter of the axis, the more revolutions it takes for the hoop to complete its spiral path. See FIGS. 20A-D. In practice this means that the smaller the diameter of the axis, the easier it is to keep the hoop spinning . . . with a small hoop it is much easier to spin it around your finger, hand or wrist than your waist. That is one of the reasons that children's hoops are not easy for adults to spin around their waists. The other reasons are weight and traction. By increasing the weight, friction and size of a hoop, an adult finds it easier and easier to spin around their waist.

As the hoop is made to circulate various parts of the body—the waist, the hips, the thighs, the knees, the chest, the arms, the neck and the hands, the patterns change with the speed, momentum and change of directions that the hoop makes. The signals coming from the sensor at any one moment allows the extrapolation of the shape of the spiral that the sensor is moving along. The hoop thus "knows" what part of the body it is moving around and in what sort of shape and the display is modified accordingly. As an example, one program to interpret the signals coming from the sensors has the color of the lights and the pitch of the sounds change, based on the position on the body. It appears quite magical.

The balance of a hoop is important if it is to be an instrument that responds coherently with the movements of the user. The placement of the batteries is important to the spinning of the hoop, particularly when it is thrown in the air, as is done by rhythmic gymnasts and hoop performers. By placing the batteries and internal components so that the weight is balanced all the way around the hoop, the performance of the hoop is improved. It spins truer and doesn't wobble, and is easier to keep moving steadily on certain paths. When you want a steady smooth sound transition or color trail, you need a steady input. If you lower the sensitivity enough to disguise a wobble, then you render the hoop less responsive.

The PSI-hoop construction allows the hoops to be used for rolling along the ground, for dancing with, for holding between two people, for martial arts practice, for all varieties of play and exercise, for meditation and for performance. One can spin a hoop that has extreme variations of weight and size and texture etc. Hoops that are 13 inches in diameter can be spun around the arms, and are used in exercise routines. The American Indians use hoops that are approximately a couple feet in diameter. They measure the height of a person and use that as the circumference of the hoop. This allows the use of several hoops spinning in different ways at the same time on different parts of the body. I have made extremely large hoops (over six feet in diameter) and they are useful to train beginners who have large girths. Within reason (the flexibility of the hoop material, the weight of the hoop, the strength of the user) . . . the larger the diameter of the hoop relative to the waist or hips or chest or thighs of the performer, the easier it is to spin the hoop and learn some basic skills. One must also consider that the hoop spins faster the smaller its diameter (relative to the size of the hub or body). Many tricks are easier to do with a smaller hoop. For its use as an instrument that can be played with the whole body (the torso and limbs and head) as well as in the space surrounding the body (moving the hoop with the hands or feet or spinning it in the air) a smaller, lighter hoop is preferable. If it gets too light it doesn't have the momentum necessary to make it follow a steady path back up the body, if it is too heavy, the inertia causes it to be sluggish in changing directions and it can be difficult to do hand movements with. So a balance of these factors is necessary to give the feel and performance that is best suited to the person. The smallest hoops that will spin around any point of the average body, and respond fast, would be around 35" diameter, though smaller hoops of 13 to 22" are good for juggling and rotating around arms and hands while using other hoops. Larger hoops are around 54" diameter, and two people can be inside this hoop when it spins.

In embodiments, the control of the lights is not done from an outside source. The performer, user or "hoopster" is the one controlling the display of light, color and sound, thus keeping the synergistic effect of the movement, rhythm and tone and color and patterns of light all being synchronized through the movement of the hoop.

The shape of the hoop itself confers an advantage. It is an instrument which can be played by the whole body. Most musical instruments have been played with the breath or fingers, but now with wireless technology we have the capacity to translate different kinds of input signals, and generate the signals for creating whatever sounds we like electronically. Other shapes have disadvantages in group situations where one does not want any sharp, threatening or pointed objects. Also the hoop shape is ideal for spinning, rolling, twirling, throwing and catching like a ball, juggling, rotating around the body and limbs and so forth. The shape of the hoop makes it ideal for bodies of all sizes and shapes and ages.

Having the hoop respond to movement, either through mechanical arrangements and switches such as the ball bearing and the contact switch and pressure sensors and MEMS and accelerometers and so forth, makes the hoop come alive and generate real interest and possibilities as an instrument, and not just as an amusing rotating Christmas tree thing . . . . It thus holds interest for a longer time and can act as both an entertainment device and one that provides learning opportunities through its feedback.

An advantage also exists in being able to use a variety of light sources, from simple single color LEDs to multiple colors, to LEDs with onboard ICs and their own programmed mixing of colors, to EL wire of either one color or multiple colors in different strands, and having those EL wires either just be able to turn on and off, or have them animated through sequencers that can run their own patterns and/or respond more directly to the movements of the hoopster. Another advantage is in having the capacity to use UV LEDs along with the other LEDs, or on their own, to illuminate the black light sensitive clothing of the performer. This transfers the light patterns onto the clothing or paint on the performer's body and as the hoop spirals in and out from the body, produces interesting and repeatable effects and patterns.

The PSI-hoop is in some embodiments equipped with a receiver as well as a transmitter. This allows signals from other hoop instruments or equipment to be routed through a central hub to the hoop itself. This is not a primary function of the instrument. The main function of the synthesizer hoop instrument is for the user to generate the lights and also the sounds that they dance or hoop to. It is not the primary intention to turn the hoop into a passive display system, that for example, pulses with the beat of the ambient music. It can be done, but then the hoop is no longer functioning so much as an interactive instrument. The design of the hoop encourages the user to generate the displays of color, light and sound through the movements of their own body.

The PSI-hoop provides real-time audio-visual responsiveness. What you do is what you get. And then what you get affects what you do. The aim is to have the instrument be coherent, where the sounds and colors are coordinated perfectly with the movements of the user. Having switches that respond to acceleration, motion, impact and so forth, adds a lot more variety to the lighting effects and synchronizes the range, speed and type of movement of the hoop with the light colors and patterns. This adds a lot more to the performance and invites the performer to exercise for longer periods. The way the colors vary with the speed and actions of the performer gives much more information about the movements of the hoop to both performer and audience. This information can be used by the performer as a direct reflection of their movement and intentions, rather like a biofeedback device, and allows for a rapid gain in proficiency with the hoop, so that the PSI-hoop functions as an instructive device.

Indeed, the hoop can be used (indoors) to great effect in the daytime, which has not been the case with previous lighted hoops. The sound function can operate on its own and so even in bright sunlight the user can get real time feedback from the hoop or perform with it as an audio instrument. The taping of the hoop includes tape that reflects bright lights in dazzling ways when the hoop is spun. This adds to the appeal when the hoop is being used in situations where there is too much ambient light for the internal lights of the hoop instrument to have much effect.

The PSI-hoop requires no retainers as the LEDs are attached to a firm but bendable wire that extend all the way around the inside of the tube and forms part of the lighting circuit. In some embodiments of the synthesizer hoop, white foam sheets (FIG. 16B, 16C) are used in the hoop to reduce internal noise and to bounce light rays. An improvement on this is the arrangement of clear or clear iridescent tape (FIG. 18). The LEDs can also be on circuit boards, or soldered to thin strips of material that has insulation in the middle and a conducting surface on both sides.

By installing UV LEDs in the hoop, controlled by a separate switch, the white, and day-glo colors of the performer's clothes are highlighted and interest is generated that way. These UV LEDs in the hoop provide dramatic effects in performance with day-glow clothing or props. Note that the UV LEDs require small windows to be made in the walls of the tubing to allow the UV light to escape. Otherwise the walls of the tube absorb a significant proportion of that light.

By varying the speed and direction of rotation, the acceleration and deceleration of the movement, patterns of light and color can be created even without the use of mechanical, electromechanical, or electronic sensors and switches. The addition of these sensors and switches (FIG. 6) 38B, (FIG. 9, FIG. 10, FIG. 11) adds more control, interactivity, and deepens the experience of synergy between the lights and the movements. The kinesthetic and visual senses are coherent, and this adds depth to the performance, and sensitivity to the feedback the performer gets from the hoop.

Figure 25A:
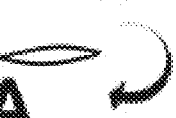
Figure 25B:
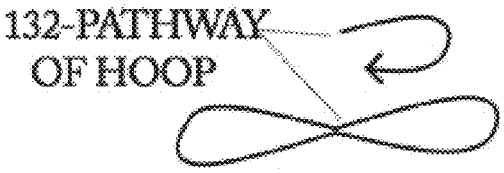
Figure 24F:
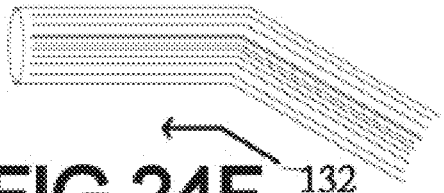
Figure 25C:
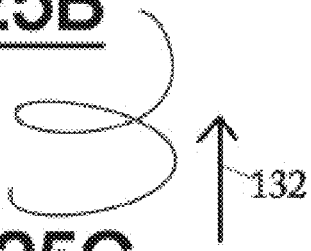

The hoop can be moved through space in many ways, and this adds variety to the colors and trails produced. The hoop can make a ball (FIGS. 26A and 26B) by being spun on the hand in the air (FIG. 27E, 27C), or on the ground. The hoop can be moved straight through space (FIG. 24E) and leave the outline of a cylinder. Geometric shapes can be created (out of light and color) by changing the direction of movement (FIG. 24F). The trails show the pathway 132 of the hoop. FIGS. 25A-C show other pathways 132 that the hoop can make in the air or around the body. These, and other pathways, combined with the spinning of the hoop itself, provide an infinite variety of display. Some of these displays are shown in FIGS. 27A-27H and 27J.

Figure 19B:
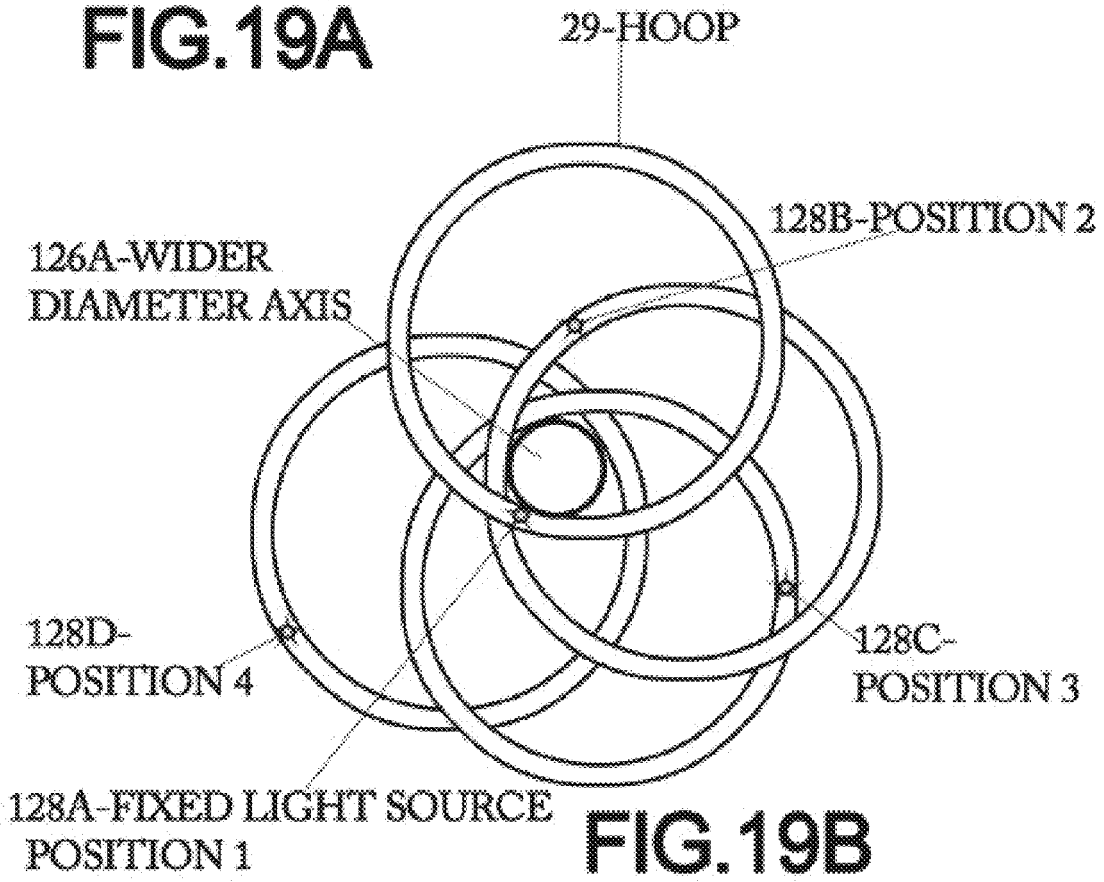

Take the simple case of spinning the hoop around the arm in a vertical plane (FIG. 27J), or in a horizontal plane around the waist (FIG. 19B). Any one point on the hoop is going to vary its speed from stationary (for an instant as it goes into the body and bounces off) to its top speed (as it reaches its outermost point on the spiral). Different points within the hoop are going at different speeds relative to the axis of the movement. This can be illustrated by holding the hoop in one hand and waving the hoop up and down, keeping the hand fairly stationary. The outer part of the hoop obviously travels much faster than the part in the hand. This variation in speed creates different color mixing effects even without the use of any other control of the LED. A similar variation in speed can be observed in fairgrounds when you ride inside a teacup that is spinning as the whole base of the ride is turning. Your speed varies; acceleration occurs.

There can be any number of LEDs in the hoop, and each LED can actually have three LEDs of different color in it, (FIG. 6) 34C and E. With a sequencer or driver (FIG. 14), each LED can also be controlled to be on or off at any one moment, to stay lit for a certain interval and to have a certain brightness value. So the lights can appear to spin around the hoop when the hoop is stationary, or to appear stationary when the hoop is spinning and so forth. The individual colors on the three (3) color LEDs can also be controlled so that the intermediary colors appear, either flashing or fading. With an electronic sensor more control is possible. The LED can be made to vary its output based on its position or speed or acceleration along any of the three axes. Thus in the case above of spinning the hoop on one axis (FIG. 27J, 19B), as the sensor and then the LEDs move through the different points on the spiral pathway, the LEDs could change from red to green to blue based on their speed, and so a flower shape (mandala) will be produced from the trails (FIG. 26C, 27J).

Hoops made according to embodiments described herein are not toys: The interactive hoop instrument is made well enough so that it performs smoothly at any speed. It must enhance the creativity, skills and display of the performer. It must not break or malfunction. It must be bright enough for thousands of people to see in a stadium or on a stage. It must have sufficient variety in display to be interesting over a period of time. It has to have sufficient control and sensitivity of its feedback systems to be truly interactive and expressive as an instrument. It has to have a range of physical and performance characteristics, so that bodies of different sizes and shapes, and users of different abilities can all enjoy it and make it perform well.

To develop a mastery of any instrument takes familiarity, practice, and purpose. As the user's skills with the instrument increase, a wider range and more pleasing displays are generated. There is an integration of sound, color and movement. This acts to further encourage practice and play. The user can't master the full range of this instrument while sitting on a couch. Dexterity, flexibility, fitness, range of motion, sensitivity, and rhythm are all developed in discovering the possibilities of the instrument. Because the lights, colors, trails, tones and rhythms are all being synchronously generated through the movement of the user (performer, hoopster, player, practitioner) there is the potential for a coherent synergy to occur that some might call art.

Figure 12B:
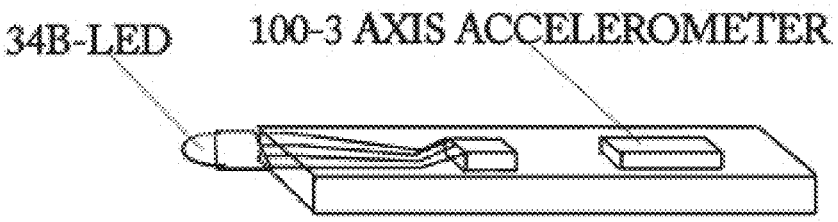
FIGS. 12A and 12B show a plan view of a section of hoop with accelerometer and ICs.
Figure 12A:
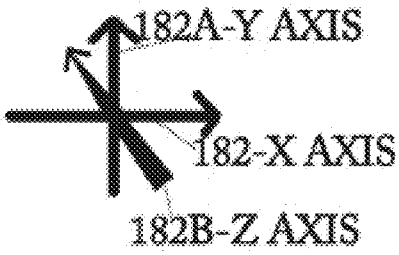
Figure 12A:
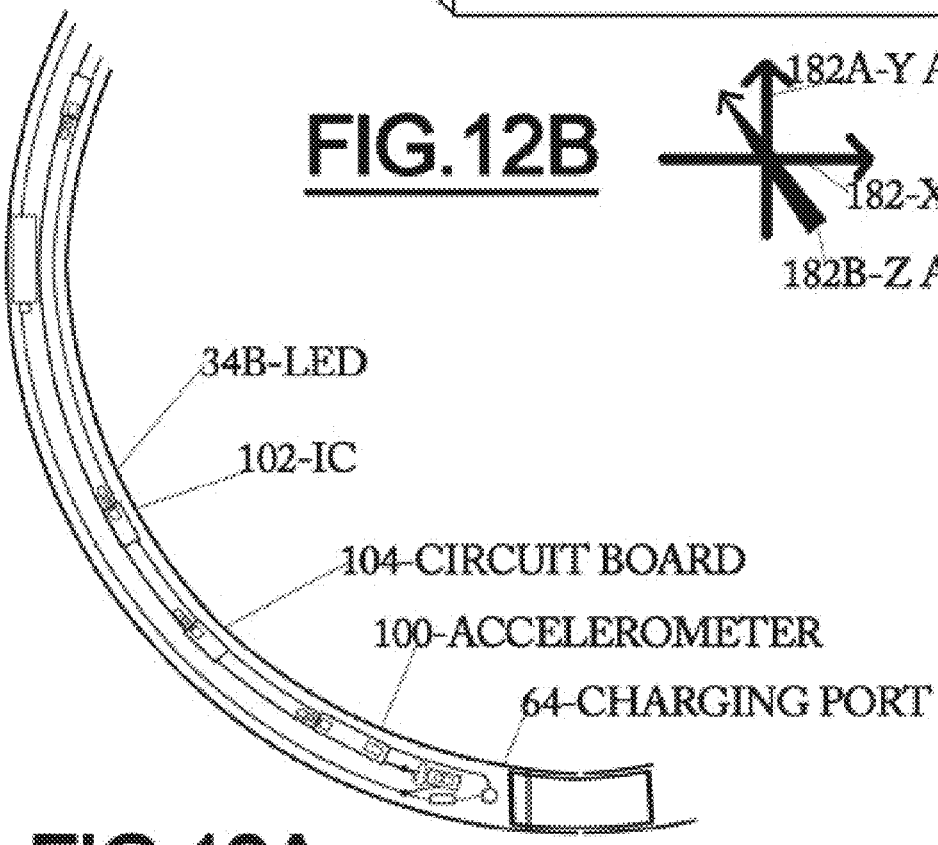

This signal coming from the sensor controls the individual colors of the LEDs, in ways that depend on the program selected. The program selected can be through buttons 108 (FIG. 14), or in this preferred embodiment, the program is selected by quickly reversing the direction of movement of the hoop, along the x-axis 182 (FIG. 12B). Other movements could be used to signal a change in program. However, the hoop performs so many different movements in the course of its use, including bouncing and bumping and being thrown in the air, that one of the more useful signals is a sudden change in direction along this axis of the sensor. The LEDs can be controlled as to their on/off state, their color, intensity of illumination, duration of illumination, and mixing with other colors. These factors can be independently controlled by the movements along the three axes of the sensors. In practice this results in an infinitely variable display. Some of the displays are geared toward performance, some favor different styles and rhythms of dance and movement, some are specifically intended to hone skills and improve awareness of the capabilities of the hoop instrument.

Figure 28A:
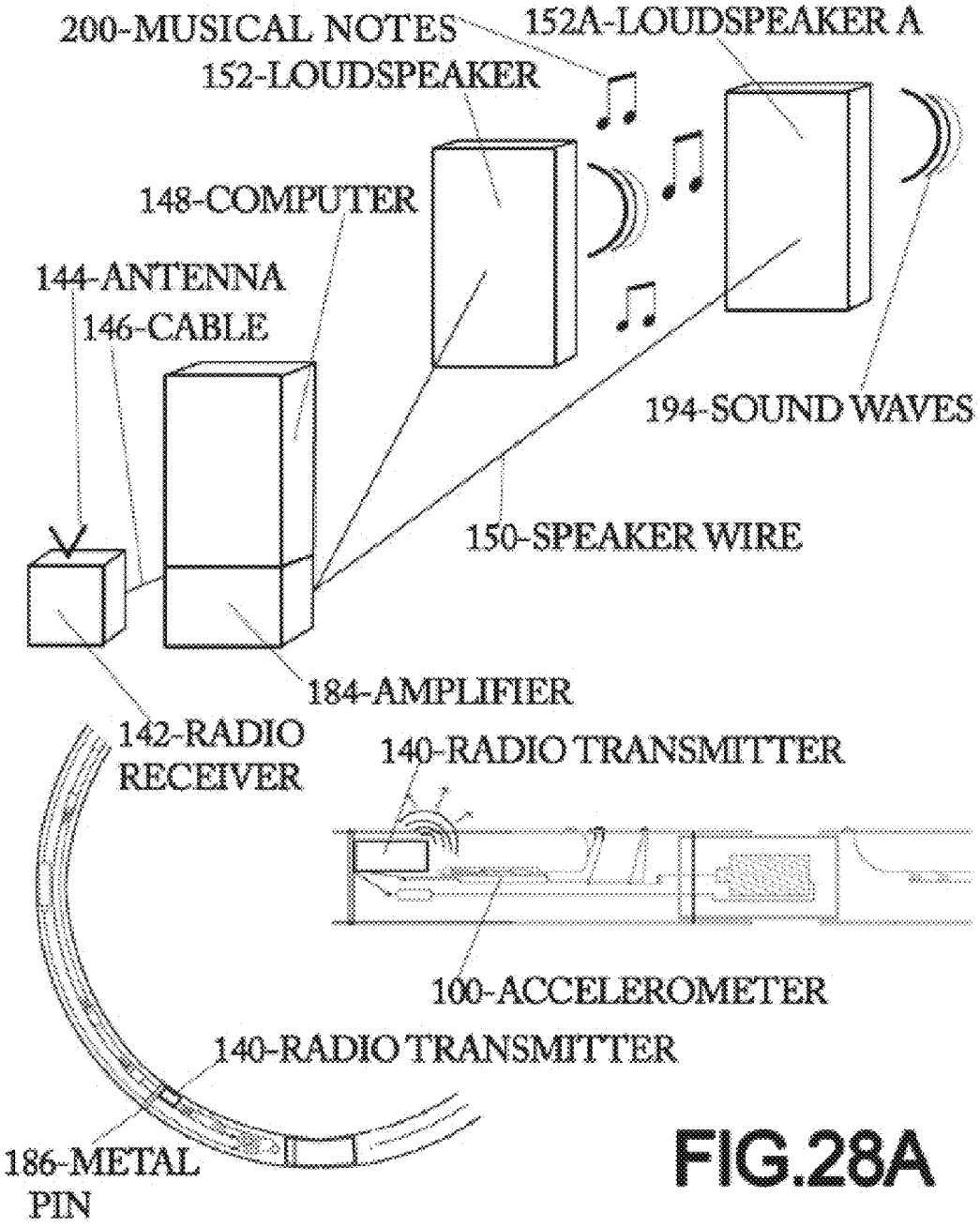
FIG. 28A shows an overview of a hoop with a wireless system.

One embodiment of the interactive hoop has sound capabilities. (FIG. 28A). The electronic sensor, (or up to 3 sensors) 100 outputs a signal depending on the movement of the hoop. This signal can be sent by a radio transmitter 140 to a wireless receiver 142. The signal goes through a cable 146 to a computer 148. The computer interprets the data and sends an output signal through an amplifier to loudspeakers 152. The way the computer interprets the data is by means of a synthesizer or similar program.

For the sound capability of the interactive hoop, the simplest embodiment uses existing music files in MP3 or .WAV format. The computer modulates qualities and sequence order of those files based on the input signal from the sensor in the hoop. The volume is modulated depending on the rhythm of the hoop. Panning between speakers is varied based on tilt (Y-AXIS) 182A (FIG. 12B). Tempo is adjusted, and pitch compensated, with the revolutions per minute of the hoop. When the hoop is moved very slowly, as in rotating it vertically in front of the body on its own axis (FIG. 19A) slow music is selected and variations occur within set limits.

The performance version of the hoop extends these sound capabilities. The input signal going to the computer is interpolated into midi information or otherwise processed. Distinct sounds and combinations of sounds are produced. These sounds, chords and rhythms are aligned to movements along the X,Y,Z axes (FIG. 12B) of the electronic sensor in the hoop. In the case of many hoops, each hoop can be assigned an address and a certain program of sound synthesis, and so each hoop can generate one type of instrument, or all the hoops can play percussion and accompany live drumming, and so forth.

The sound capabilities of this lighted interactive hoop allow it to give feedback even under bright lights. The visual display will be dim or unseen, but the sensors will still send their signals to be processed as described above.

The synchronization of body movements with the colors, trails and patterns of the lights, allows a whole new form of expression and experience. With the addition of sounds generated from the same signals, a coherence of sound, sight and feeling is produced. This increases the interest in viewing the performance. It allows for very detailed and obvious feedback to the user about their quality of movement. It rewards increased skill with more range and control over the audio and visual displays. The hoop becomes interactive in that every movement made by the user is associated with audio and visual perceptions. These perceptions affect the quality and range of the user's movements, which in turn result in more coherent, pleasing, informative or interesting displays and sounds. The synergistic action of the sounds and visual imagery produced deepens the kinesthetic sensation. The hoop becomes an instrument that combines the characteristics of a ball, video game, and piece of exercise equipment, with a musical instrument and a light show all in one!

Programmable PSI-Hoop Embodiments

Figure 30:
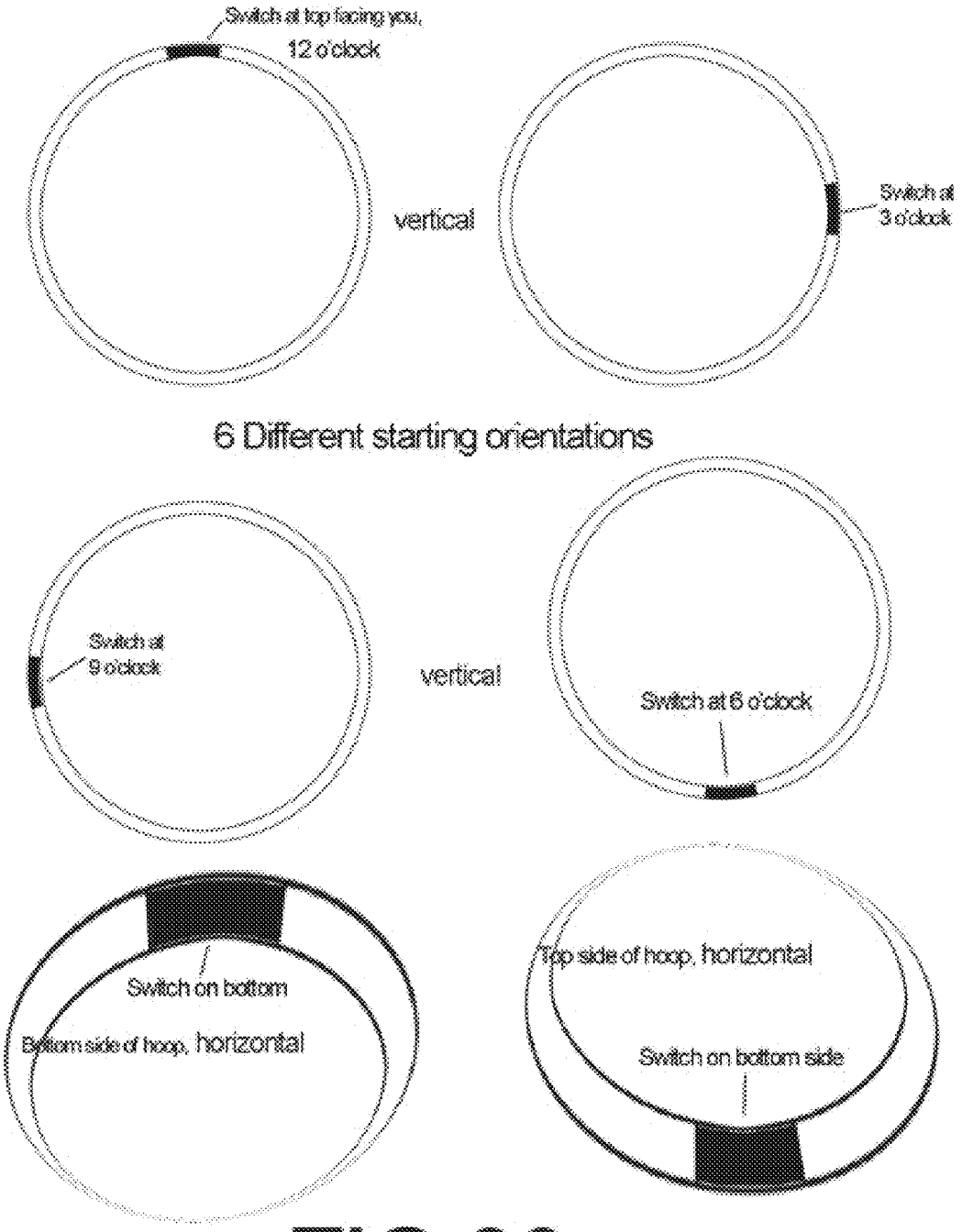
FIG. 30 shows example starting orientations for a hoop instrument.

In embodiments, the PSI-hoop can be programmed and interacted with both in setting it up and in real time. As shown in FIG. 30, there are at least six (6) different orientations that are used to give the user access to different sets of displays. For this example, these are the six starting points for interactivity with the PSI-hoop.

One external feature of PSI-hoop is that it has no physical controls except for an ON/OFF switch, though it can be programmed in dozens of ways through actual movements made by the user. In embodiments, the PSI-hoop uses the shape and properties of the hoop itself to give complete control and interactivity to the user, both in setting up the hoop displays prior to performance and play, and in controlling the displays in real time as a user is hooping.

Other methods in the art use components which allow the user to either just vary the display automatically based on a preset program, or to change programs with buttons or joysticks on the outside of the hoop. Obvious disadvantages of these current methods used by others, is that it either reduces the possible displays to a mere fraction of what is available, or involves the user in fiddling around in the dark with buttons and controls.

Be that as it may, the PSI-hoop has 6 orientations that open into different display environments . . . and these orientations are oriented on each of the hoop's 6 "sides". For example, looking at the hoop with the button facing you, there is a top (12 o'clock or north), bottom (6 o'clock or south), left side (9 o'clock or west) right side (3 o'clock or east) front side (hoop horizontal to the ground with button/face up) and back side (hoop horizontal to the ground with button/face down).

If the hoop is standing up on its edge with the button switch facing you when you turn it on, you will go into a mellow set of hoop displays. For each of the other orientations described above, when you turn the hoop on you will go through another orientation and be in a totally different set of displays. That gives you the 6 starting points.

In each of the 6 starting orientations you will find a "quiver" of "hoops". In these examples, the term "hoop" refers not only to the overall PSI-hoop but to the individual display characteristics of a particular set of parameters that gives the hoop a certain look. A quiver contains one or more hoops, and several quivers make up a "pack".

Try turning the hoop on when its standing up with the switch at the top. Notice that whole hoop turned aqua for around a second. The color change is just to confirm where the switch was oriented when you turned it on. Turn the hoop off again and lie it flat with the switch upwards. Turn it on in this position. Notice that the whole hoop lights purple for a second. This confirms that you turned the hoop on when it was lying on its back. Each of the 6 orientations will light a steady color when you enter it by turning the hoop on in that particular orientation.

The basic way to change from one hoop to the next in a quiver is to make a simple flip move. Starting with the button switch facing you and upwards, hold the hoop with both hands and rotate the top of the hoop away from you and downwards. Rotate all the way till you have gone at least 180 degrees, meaning that the switch is now at the bottom of the hoop and facing away from you, and if necessary continue rotating till you see the display change. It might take you several rotations to achieve the correct result, so be patient and easy. You will now be in the next hoop.

The speed/smoothness/acceleration-deceleration with which you make the flip is a factor, so practice at different speeds. If you flip the reverse direction you will go backwards in the quiver to the last hoop, which is fine, but often you will want to know where you are in a quiver and should usually start with the hoop in the default starting position for changes, which is with the switch facing you and at the top. If the switch is too far off to one side or the other, you wont be doing a front flip or a back flip and you may get other unexpected results. The signals have been calibrated so as to maximize their accuracy and repeatability. At the same time you wont have to worry that you make any of these moves accidentally—it's a rare occurrence. If the signals were too easy and commonplace and could be performed sloppily you would have a lot of mistakes in communicating with the hoop. Thus the necessity to be somewhat careful and precise in making the signal movements that tell the hoop how to change its displays.

A forward flip signal movement can be made by holding the hoop in other positions and making the connector part/switch part travel in the same movement as it does in a front flip. For example you could hold the side orientation area of the hoop and twist the hoop around its own axis. But the advice here is to start simple and follow these directions until you get much more familiar with the PSI-hoop. Otherwise you might get frustrated, annoyed, confused, and fail to make as easy and rapid progress through the learning curve.

Reset: The hoop will remember many things, and sometimes we want to back out of a display or get back to our starting point, so to clear the hoop's memory in any orientation we give it a continuous shake right after turning it on in that orientation. No need to be crazy, but it does take a little animation an ideal way is if you make a circle with your forefinger and thumb and have the hoop inside that circle and lightly just wiggle and shake it till you see a red sequence go all the way around the hoop. When that sequence goes all the way around, everything is reset to its starting place for that quiver.

Start with the hoop vertical and the switch facing you at the top, and turn it on. It will flash aqua. You will be in the quiet quiver. Now shake the hoop till it resets. Turn the switch to the right or left side (9 oclock or 3 oclock) so you don't accidentally flip into the next hoop. You should see a hoop with steady LEDs—no flashing or strobing . . . but if you slowly tilt the hoop in different directions you will notice that the colors vary directly with the rotation and tilt of the hoop. This is a chameleon. (Most of the hoop displays in a PSI-hoop don't have individual names, as there are millions of them . . . but you will notice that in general they belong to a certain class or group or species of hoop). The chameleon is one species of hoop display, and at one point in this instruction manual we will do a taxonomy of the hoops, giving them names and categorizing them, so you can recognize and work with them more easily).

The PSI-hoop is not only about displays however. Its more about playing with the displays, letting the display change the way you are hooping, and then seeing how that again changes the displays, back and forth. There is coherence between the movement and the display, allowing a more intimate involvement for the performer, and more connection to the audience. The interactivity provides the opportunity for accelerated learning and for expanding the repertoire of the hooper. The PSI-hoop supports experimentation, play and learning. Not only are you interacting with the hoop itself as a physical object, but also with the displays, especially the ones that react to your movements.

The PSI-hoop functions as a regular hoop and also as a dance partner, an interactive instrument, a tech toy, an engaging teacher, and a communication device for enhancing your connection with an audience.

In the hands of an adept, the PSI-hoop becomes a real instrument. You can keep to the beat and use it as a percussion instrument. You can follow a melody and punctuate that with color and effects and contrast. You can express a wide range of perceptions with it, communicate through it with others, and have ever increasing control over the very wide range of effects you create, improvise, repeat etc. Its supposed to be fun and engrossing and to provoke improvisation, invention magic and mayhem.

As in a musical instrument, it will take a while to master the PSI-hoop, but the learning curve is intended itself to be a game and to be interesting and rewarding. You can pick up the PSI-hoop, turn it on and hoop with it to great effect without knowing any of this information. Simple experimentation will produce great results, as long as you are not attached to the outcome, and just enjoy interacting with whatever appears. If you have not learned the basic signal moves and layout of the whole hoop you might get frustrated if you are trying to achieve a particular color or display, for example something cool you saw in another PSI-hoop or that appeared in the middle of your dance or performance and then disappeared again. In time you will navigate effortlessly around the hoop and be able to generate a plethora of patterns at will.

Try turning the hoop off and starting it again with it horizontal and the switch UP. This is the orientation to the Quirky Quiver. Flip through a few of these and you will notice they have a lot more going on than the hoops in the quiet quiver.

As you are flipping through various displays you may come to one that fits your mood and purpose at that moment and want to stay with that display without accidentally flipping into another one. That would be the time to use the lock display move which is:

lock display: RH ISOFLIP, HALF-BACK.

The easiest way to learn this move would be to have a more advanced psi-KO-hooper show you, and it would take you less than half a minute to master it. But lets say you just got your new PSI-hoop sent to you while you are on a field trip studying Orangutans in Borneo, and of course wanting to see what the Orangutans responses will be to this circle of flickering fire . . . and no reception . . . then you have to learn this the hard way through these instructions.

We define ISOFLIP: a half rotation of the wheel, (an isolation) starting with your hand on the connector area of the hoop with the switch facing you and at the top of the hoop, and going around the imaginary wheel till your hand, connector and switch are at the bottom of the hoop. Then instead of continuing around the circle or reversing the circle, you bring your hand towards you and up to the beginning location . . . its a circle up to the starting position but in a different plane, at right angles to the first one, so that the switch is now pointing away from you. You have flipped the hoop while keeping its axis or center point in the same place. Iso-flip.

A RH isoflip (RH for Right Hand) starts with the right hand holding the hoop, and the movement is counter clockwise, or the most natural way for you to do an isolation with your right hand. Since we are using the term clockwise, we may as well continue with the clock analogy. Isoflips start at 12 oclock and end up there. An isoflip can be done with the left hand=LH isoflip or simply isoflip (if there is no LH or RH noted then it's a left hand isoflip—because when we started making the signal moves, we used only the left hand)

So the move is: Lock display: RH ISOFLIP, HALF-BACK.

Start with the right hand and go counter clockwise (from 12 oclock to 9 oclock to 6 oclock) and up to the top as in any ISOFLIP. The switch will now be at the top and facing away from you. To do the half-back (figuratively speaking) now do a half isolation or turn of the wheel, still holding the hoop with your right hand and going through 3 PM to 6 PM and then back to 3 PM and 12 PM. The move needs to be steadily consistent all the way through the isoflip and half-back.

If you do the move correctly the hoop will flash blue to show you its now locked in that display. If you want to toggle out of locked back into regular FLIP-mode, then do the move again, and when you get it done correctly the hoop will flash white to show its now free and clear of that.

If you turn the hoop off with a display locked, then when you go back to that quiver by turning the hoop on in that orientation, the same display will still be locked. Do the same move: RH ISOFLIP, HALF-BACK and you will clear it. Another way to clear it is to turn the hoop on and shake it immediately to reset it. Remember you have to continue to shake it till the red sequence has gone all the way around, or you wont get a reset. So now you can LOCK and UNLOCK a display. Maybe you only need one display for a performance, and so best that it is locked into place.

You like the pattern of a certain display, but you want to try out different colors and different color schemes (combinations of colors) in that one display . . . you need the move called:

TOGGLE_COLOR_FLIP=RH ISOFLAP 180 HORIZONTAL, DROP HOOP DOWN

This will allow you to stay in the same pattern (layout, arrangement) and effect (the LEDs are fading or strobing or sequencing around etc), but with new colors. And now when you do a flip, the hoop will change colors predictably and stay in the same pattern and effect. If you get to one combination you really like, then you can LOCK that display and stay there for a while. Or turn the hoop off and then turn it back with the switch in the same orientation (in this case its UP and in quiet quiver. Or its UP with the hoop horizontal and in the quirky quiver) and you will be back in the same display. You can go through other orientations in the meantime, and play with lots of other quivers and hoops, but when you come back through this same orientation, your locked hoop will be waiting for you.

How do I do the TOGGLE_COLOR_FLIP move? It says RH ISOFLAP. Grip the hoop with the right hand and start an isoflip. Before completing the last part of the isoflip however, the part where the hand goes "straight up" from 6 oclock to 12 oclock, you stop with the hoop parallel to the ground and you turn it 180 degrees in either direction . . . one way will be easier, so use that way . . . and then let the move complete by allowing the far side of the hoop to descend from horizontal to vertical. That is an ISOFLAP (the horizontal part may visually be something like turning over a pancake or FLAP jack or opening a powder case in a make-up kit.

You can use two hands in this or any other signal move. In this case use the left hand to steady the hoop and guide it smoothly on its path.

Practice the RH ISOFLAP till you have it down easy, and get it right 100% of the time, and until the hoop hears you perfectly. Can these hoops learn? Do bears cubs frolic in the spring? Certainly it wont take you long to discover how to do the ISOFLAP and you will use it in several other signal moves. Flip the hoop till you get to another pattern you would like to explore in colors. At this stage we recommend flipping in quiet quiver seven times to get to an alternating color pattern called "Cheshire cat". It's the one after a slowly changing/flowing rainbow hoop and before a hoop that is all one color—twinkling and circulating around the hoop. To get there with front flips you will start (if you have reset the quiver or just going there for the first time) in the Chameleon which changes axes as you gently move the hoop around, and go through an all gold hoop, then a hoop with segments of different colors that slowly fade, then an elfin hoop (fading colors with dark spaces between each LED) then the similar elfin but with alternating white LEDs, then a rainbow colored hoop with lit segments and dark spaces in between each segment, then the full RICA (Rainbow In Curved Air) and into the hoop we are looking for, the alternating gradients of colors called the Cheshire.

Do the TOGGLE_COLOR_FLIP move=RH ISOFLAP. When you have done it correctly the hoop will flash yellow, to show you its in this new mode. Flip the hoop frontwards into an all white display and again frontwards into a red/orange/yellow/pink fading hoop. Flip backwards, through the white to the original and back again to a pink and yellow one. Try flipping through the colors and hooping with each color a while to see how freely you can hoop without accidentally telling the hoop to change its color. Practice your flippery until you can get the hoop to recognize your flips perfectly.

LOCK one of these displays so that when you flip the hoop will stay in the same color and pattern.

lock display: RH ISOFLIP, HALF-BACK.

Remember this move and do it again to UNLOCK the hoop and cycle on.

Do the quiver reset move (shaking just after turning the hoop on) and start back at the beginning. Play with the above signal moves till you can wander around in quiet quiver with ease, resetting the hoop when you get confused, flipping from one hoop to the next, flipping back to a previous hoop, locking the hoop and unlocking it, setting toggle color flip on so that you can cycle through colors in one pattern, and toggling the color flip off again.

So what happens if you have a display locked and you really like it and would like to get back to it easily, but you need to change displays for some other reason . . . to show someone something or find another display for a performance, or continue your exploration of the PSI-hoop etc. . . . you can either turn the hoop off and then on again in a different orientation to change orientations (which automatically means that the hoop you liked will be remembered next time you go through that orientation to open that particular quiver), or you can SAVE the hoop.

The move for doing this is: SAVE: ISOFLIP, HALF-BACK.

You already did the RH ISOFLIP, HALF-BACK, to LOCK the display, and this signal is just the same move done with the other hand and in the other direction. When you come to the end of this move, and have done it well enough that the hoop recognizes it, the hoop will flash greyish white, and a row of lights will appear to the left of your left hand. Your left hand is holding the top of the hoop with the switch away from you. Move that hand in an isolation to the left, in the direction of the lights, and you will see the red light next to your hand move down along a row or lights. You may need to continue the isolation quite a ways to accomplish this. There will be a red light lit and then two white lights, then a yellow light and then three white lights and then a yellow followed by three more white. The white lights are the locations of the saved slots in each quiver of three. The yellow light marks the end of one quiver and the start of another. So you have three quivers in the SAVED address, and 9 possible slots to store a hoop in.

Once you have moved that red light to any new white spot, change the direction of your isolation till the hoop flashes white and that hoop will be saved at that location in one of the 3 saved quivers. You can also move a hoop from one location in the saved quivers to another spot in that quiver or in the other 2 quivers . . . just select that hoop and then do the SAVE move and rotate until you find the quiver and spot you would like to have it. It will now be in both locations in the saved orientation, or quelled quivers. When you do a performance, you may want several different known displays available in a certain order, and you can set that up here. If you want to have three variations of the same hoop, you can set that up in one of the 3 saved quivers, perhaps each one with different colors or other variations. Or you could have 3 hoops that will flow together for a performance.

To flip between hoops in the quelled quivers is the same as the flip in any other quiver. To go between one quiver and another is a different move:

Example: THE SIDE FLIP

Hold the hoop as though you were going to do a front flip or back flip (previous gymnastic training not necessary) and rotate the hoop so that the switch is on the right side/3 oclock/east/that way and then do your normal front flip. Do this three times without stopping, or rather the next quiver. Doing the backwards side flip works as well, though of course it will take you back a quiver in the saved selections.

Go back to the quiet quiver, through the orientation that is available with the switch UP at the top of the hoop and facing you. Shake the hoop within a couple seconds of turning it on, and continue shaking as the red light sequences all the way around the hoop. You are now back in the starting position for the quiet quiver. It is a hoop that changes color depending on its orientation. If its upright with the switch facing you, it should be in a yellow white red color scheme. Do a backflip into a white hoop (might take you 2 or 3 flips to engage the backflip function) and another backflip (should only need one backflip now) into a segmented hoop that has 5 blue and white segments. Turn the hoop so the switch is on the left side at 9 oclock and flip it either way. You should see the same pattern but in a red color. This is a hoop that has two different sides, and the indicator for that is a short blue segment that lights up when you first get into that hoop.

The only other hoop in quiet quiver that has 2 sides is a couple hoops back from this one. So do a backflip into a pink hoop and another backflip into a hoop that has 3 long segments moving in one direction and 3 other long segments moving in the opposite direction. If you do a side flip with this hoop you will go into a similar hoop with many more shorter segments.

In quiet quiver there is another signal that uses the sideflip. Go to a display in quiet quiver that has no segments and has all the LEDs lit. Then do three forward sideflips. You should see a section of white appear in the hoop. Shake the hoop a couple times vigorously and you should see the white section get bigger. If you do three backflips you will get a similar result but with a dark area instead of the white. These dark and white areas are tied into fast or chaotic movement and are fun to play with, both on and off the body.

Turn the hoop off and back on in quiet quiver (switch facing you and UP). Shake the hoop to reset it. Front flip to a two color hoop which has around 20 segments of alternating colors. One of the colors is fading, though its subtle so you may not notice it immediately. Lets say you like the effect but want it in a specific color.

Do this move: SELECT COLOR: ISOFLAP 180 HORIZONTAL, DROP HOOP DOWN

You already did the reverse/mirror image/other direction of this move (TOGGLE_COLOR_FLIP=RH ISOFLAP 180 HORIZONTAL, DROP HOOP DOWN)

Figure 31:
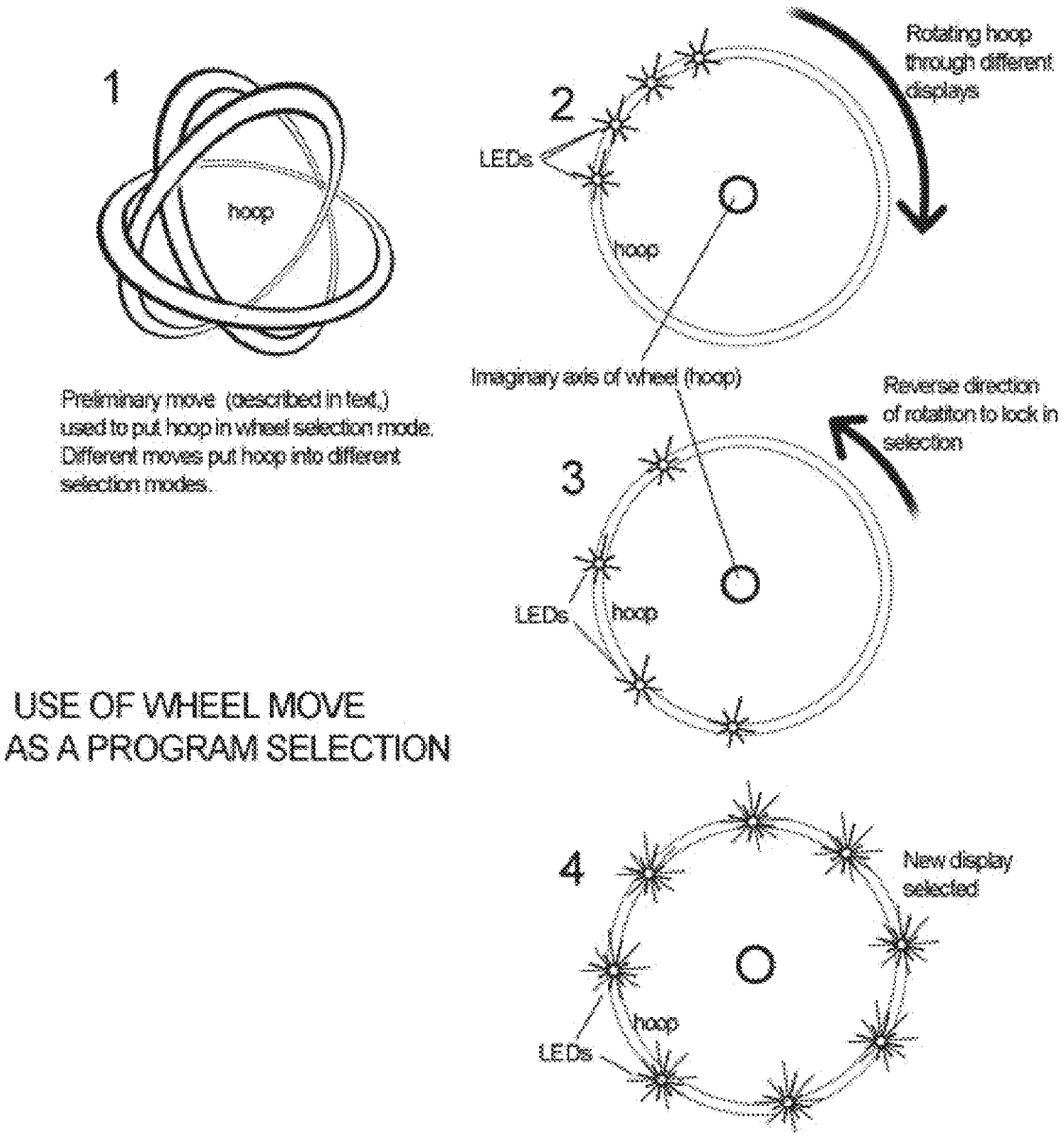
FIG. 31 shows example use of a wheel move as a program selection.

A move shown in FIG. 31 is very similar. Just start with your left hand. The hoop will flash white when you have done the move correctly. You are now in Merlin's Wheel. Without making any other motion, start a slow rotation to the right-clockwise, from 12 oclock towards 3 oclock, and you will see the colors start changing . . . you are going through many different possible color schemes (combinations of colors) and some single colors. It should start in a rainbow scheme and then go to a white and then a white/yellow/red and then an aqua scheme and on through around 30 color schemes. When you get to a color scheme you wish to use, reverse the rotation of the hoop, and it should blink white to confirm that you have selected that particular color. Now you will stay in that color scheme even when you flip to a new pattern hoop. So you can have many different hoop displays in a quiver with a continuity of color.

If you miss the color scheme you want, you will unfortunately have to repeat the signal move and go around the wheel till you come back to it.

Once you have selected a steady color or color scheme in a specific quiver, that color scheme will stay for all the hoops in that quiver. Note that many color schemes have a complex array of colors and you may see unexpected colors appear, so get familiar with the specific color schemes you enjoy, and note what colors appear in that scheme and in the various displays using that scheme. The color wheel starts off with color schemes in rainbow, white, red/white/yellow, aqua, and shades of pink. Then a series of single colors—red, yellow, green, turquoise, blue, pink, magenta. If you want the hoop to be just one color, choose from the white or the other single colors. After the single colors on the wheel there is a series of color schemes—rasta, earthy colors, rainbow with no pinks or purples, rainbow with pinks and purples, rainbow with indigo and white, pastels, blues and whites, greens and pinks, greens yellow purples, pinks and purples, white, yellow and dark, red white yellow, blues and greens and more pastels. Some of these have variations. The you will be back in the rainbow followed by white etc.

Lets go to the quirky quiver. Turn the hoop off, hold it horizontal with the switch UP and turn it on. You should see a purple flash for a second, to indicate you are in quirky quiver. This hooping environment is a lot more active than the quiet quiver. Here is one way to view what is in a quiver, and also a great way to create a varying display when hooping. It will result in an automatic advancement of one hoop to the next. TOGGLE_AUTO_CYCLE=RH ISOFLIP, RH ISOFLIP (like you would do the regular left hand). Grasp the hoop with the right hand with the switch UP and facing you . . . do a smooth rotation to the bottom and then go straight up to the top as in any isoflip, and then without taking your hand off the hoop repeat the move, but going in the opposite direction (will be the only really possible or easy direction). If you have done the move correctly you will see a green flash. The hoop will then start to change displays every 5 or 6 seconds.

To speed this process up and get exact control of the rate of change there is another move called TAP BPM (tap is the finger tapping and BPM stands for beats per minute:

TAP_BPM=ISOFLIP, ISOFLIP (hand stays on hoop)

Its the same move as the TOGGLE AUTO CYCLE above but started with the other hand, the left hand.

You do two isoflips and the hoop flashes pink/white and goes yellow. Its now ready for the tap:

You hold the hoop loosely at the connector area, best to hold it with two fingers so its quite loose, and then tap the hoop near to the connector. The taps should be distinct, clear and in time with each other. If there is some music playing, start mentally or physically tapping the beat and then tap the hoop at least three times at that rhythm. The display will now change at that interval If you want a faster change, you can do that with colors, but not with the whole hoop display. The idea is that the whole hoop display takes a couple seconds to gear up, especially if its motion sensitive, and so it loses a lot if the change is made too quickly, However if you stay in one hoop and vary just the colors, then that works well at quicker speeds. It takes three taps to make the time signal and the hoop will flash white to let you know it is responding to your signal.

Turn the hoop off and then on again in the quirky quiver. Flip forward to the Cheshire (it's a little more hyper than the Cheshire in quiet quiver, but still recognizable). Do the color flip move:

TOGGLE_COLORFLIP=RH ISOFLAP 180 HORIZONTAL, DROP HOOP DOWN

Then flip it forward or back to check that the display is changing with each flip.

Now do the toggle autocycle move: TOGGLE_AUTO_CYCLE=RH ISOFLIP, RH ISOFLIP

And the hoop will start to change colors and stay in the same Cheshire Cat pattern.

Now speed up the rate of change, the BPM, you will need to tap twice as fast as the beat you are matching TAP_BPM=ISOFLIP, ISOFLIP (hand stays on hoop)

And tap three times (better to have option of simple color schemes, cos that makes it more obvious and possibly faster whole hoop pattern changes?)

Now that we are in the quirky quiver, lets explore an option for just this one quiver.

Turn the PSI-hoop off and back on in the horizontal orientation with the switch UP. Once you see the purple flash, let the hoop drop into vertical and shake it till its reset. Note that the shaking has to start within a second or so of the hoop flashing purple, but best to wait till its finished its purple flash before shaking, otherwise you sometimes shake yourself clear through another orientation. You should be in an all white segmented display (white and dark areas about equal lengths). Front flip through 3 or 4 more hoops (first one will be a white flickering display, then a pink and white, then the Cheshire, then a white flickering display that becomes colorful if you shake it, and then you will get to a hoop with 2 circling orange segments. Lets say you are particularly curious about this hoop and want to play with similar ones. There is a move that will take you from this hoop and also most of the remainder of the quirky quiver hoops through another orientation into the quantum quiver. You will be in a quiver of similar hoops and can use a front or back flip to navigate through the quiver.

FIND_PACK=ISOFLIP, QUARTER TURN CCW, SIDE FLIP

To do this move, do a regular isoflip, starting with the left hand and when you finish the isoflip with your hand at the top of the hoop at 12 oclock, then do a quarter circle to the left, counter clockwise, ie from 12 oclock to 9 oclock and then do a forward side flip. If you are successful you will see a pink flash followed by a short red segment . . . the pink flash indicates you are now in the quantum quivers. You will then be in the same hoop you were playing with in quirky quiver, but if you front or back flip now you will get to a whole series of similar hoops.

If you turn the hoop off now, and then back on with the switch on the left side, at 9 oclock, you will get a pink flash to indicate you are back in the 9 pack, and then the same hoop will appear as when you turned the quantum quiver off.

Reset the quantum quiver by opening its orientation (turning it on with the switch at the left side and facing you) and then shaking it till the red sequence goes all the way around. Turn it off and back on again and do some side flips to navigate through the separate quivers in the 9 pack.

This above is just the first section of a tutorial on the use of the PSI-hoop. There are many more moves that signal the hoop to change displays, that let you navigate around the displays, and that set parameters so that the displays change in different predictable ways in real time while hooping. There are moves that select random changes and those also can be synchronized to the ambient music.

I have not yet developed the wireless/Bluetooth functions, but they will allow us to do more intensive computations, to store more programs, to generate sound and music that is directly coherent with the visual displays, to control laser and other equipment at a distance, and to receive signals from central controller or other hoops in order to synchronize group displays.

A main point of distinction over other hoops currently in the art is having a 3 axis sensor, and other sensors that allow you to know the orientation, position, acceleration, speed, direction and movement qualities of the whole hoop and of any part of the hoop at any instant.

Signals to talk to the hoop, including but not limited to:

- Rotations and combinations of rotations and straight lines and different axis rotation etc (called isolations and isoflips etc)
- Flip move to change displays
- Starting hoop in different positions and orientations leads to whole different sets of displays
- Color wheel (moving the hoop in a circular path around its own axis, like a steering wheel) allows selection of colors and other selections of variables like which hoop to display, or what kind of speed a strobe is, or where to store a hoop in the saved quivers etc)
- Lock and unlock displays
- Programming hoop without buttons
- Save modes and different modes accessed through movement
- Speed of sequences controlled in real time by wheel movement
- Rhythm of hooping controls displays.
- Tapping a beat to signal the timing of the display (is listen to the music then tap the hoop at that beat and the hoop will now change its displays in rhythm)
- Any and all display characteristics controlled by movement speed of the hoop, and other movement qualities . . . like stopping the hoop in a certain position for 3 seconds, or going from slow to fast etc etc

Additional Embodiments

Figure 6:
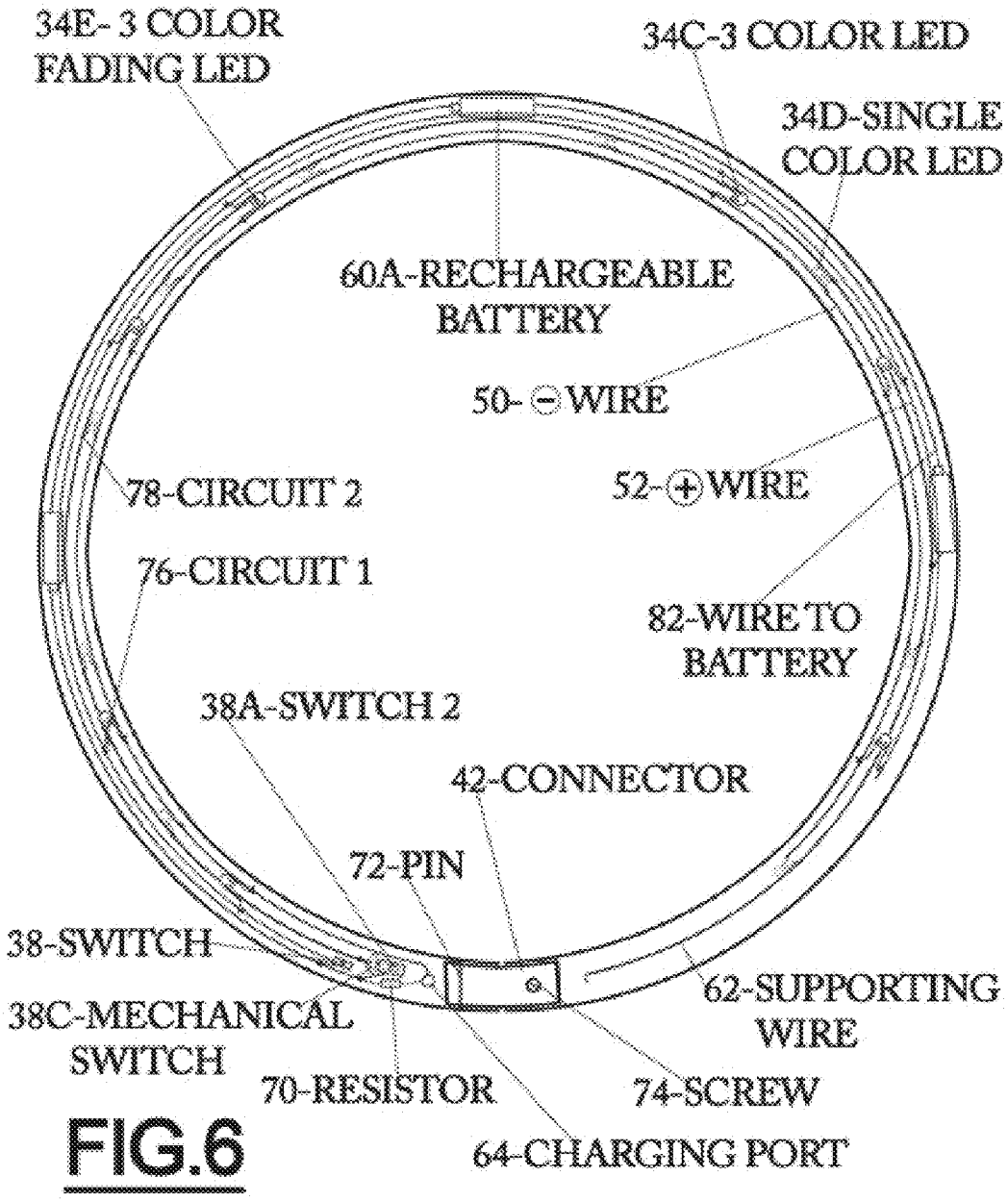
FIGS. 6 and 6A shows a plan view of the insides of a hoop.
Figure 6A:
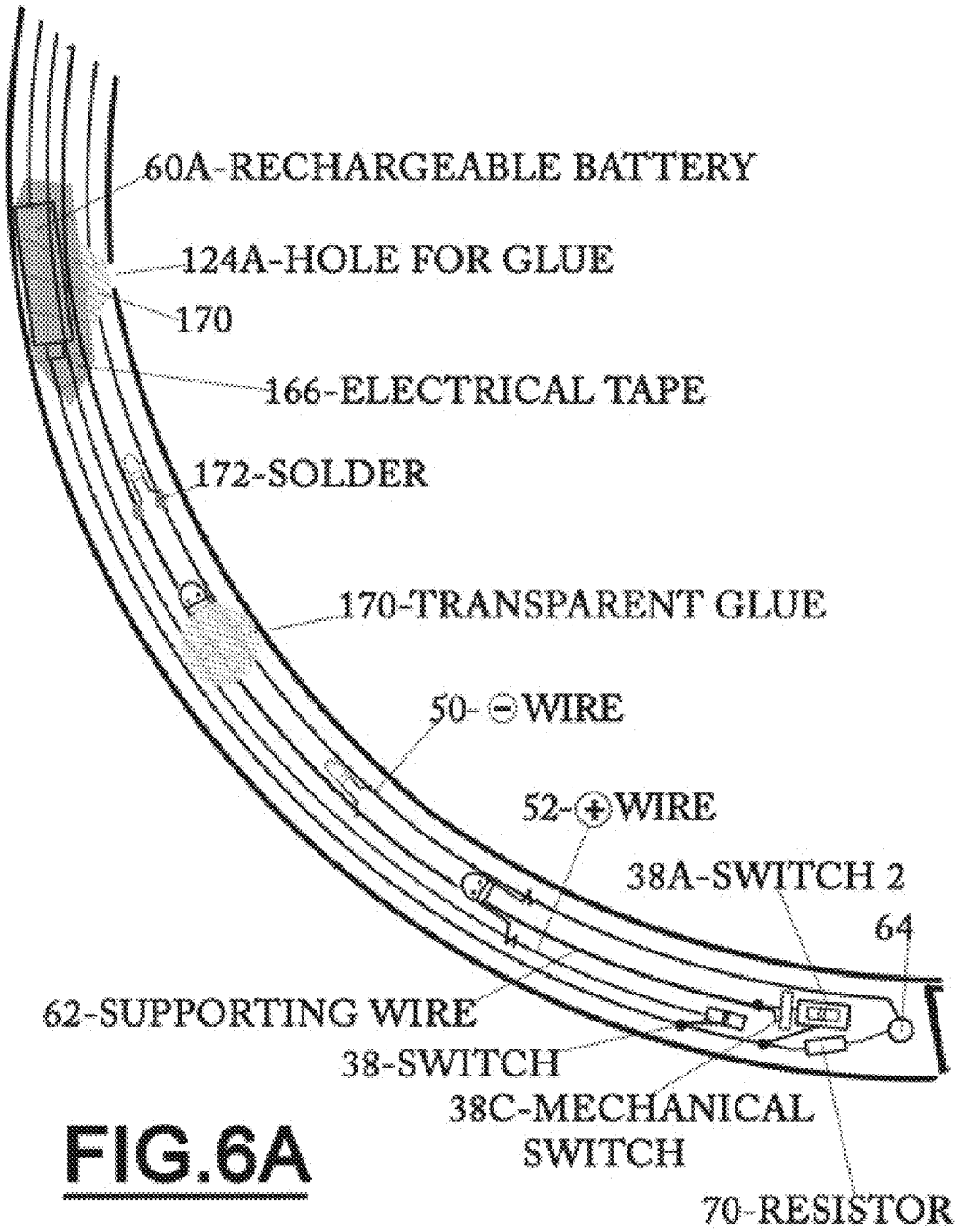

An alternative embodiment is shown in FIG. 6, a simple hoop with two circuits 76, 78. There are two switches 38,38A, to allow for different effects in the lighting to be created manually. The hoop has a mechanical or electro-mechanical switch as shown in FIGS. 9A, 9B, 10A, 10B, 10C. The switch in FIG. 9A consists of a ball-bearing 86 rolling back and forth inside a copper tube 90. There are two sections of copper tube with a gap between them. When the ball bearing rolls across this gap it makes electrical it completes the circuit. The copper tubes are held in place by being inserted in a plastic tube which holds them tightly. At one end of each copper tube there is a bend 90A to keep the ball bearing inside. The whole arrangement can be placed at different angles to the hoop tubing to vary the way in which the ball rolls.

Figure 4:
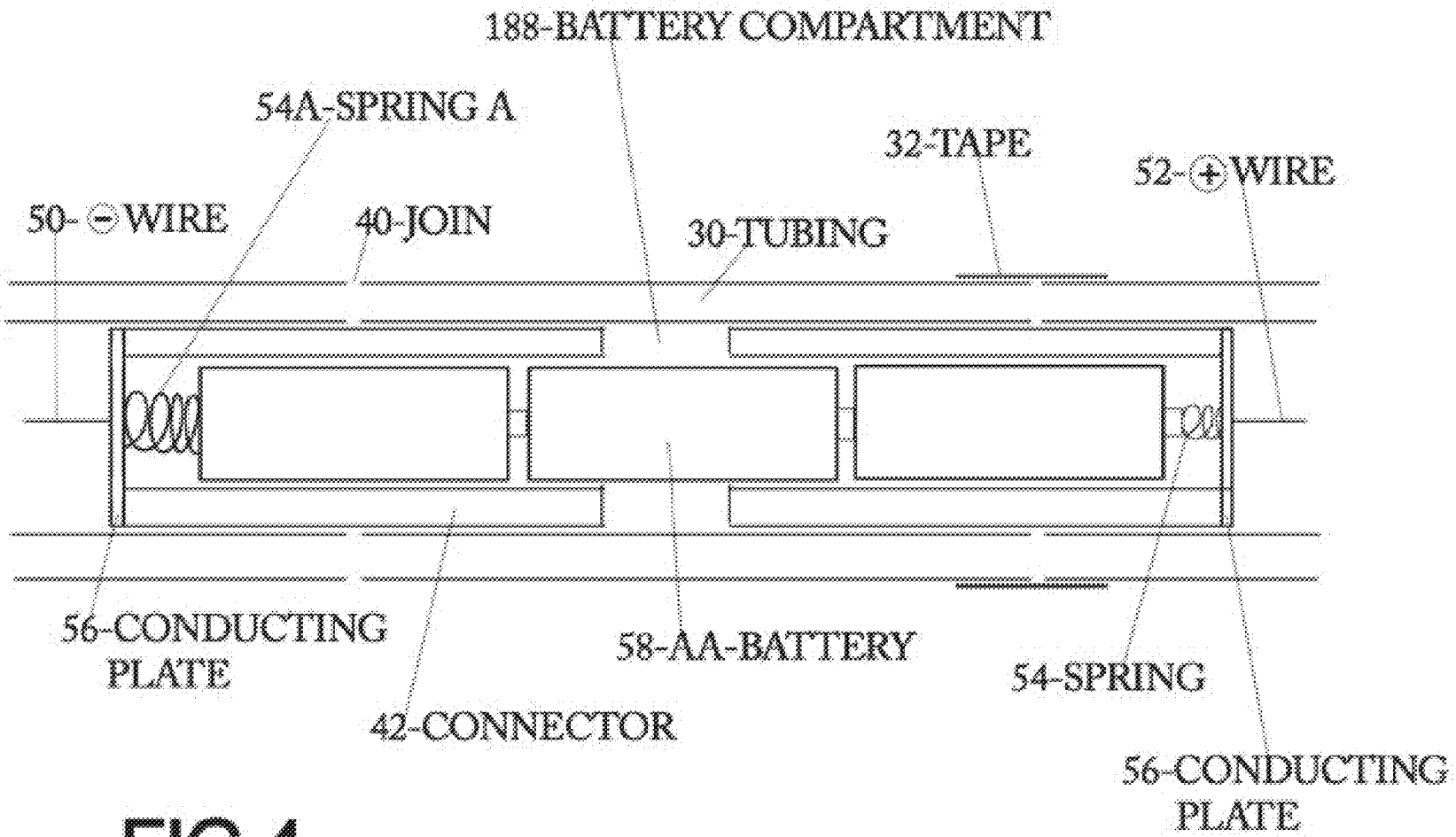
FIG. 4 shows a side view of a battery compartment
Figure 9B:
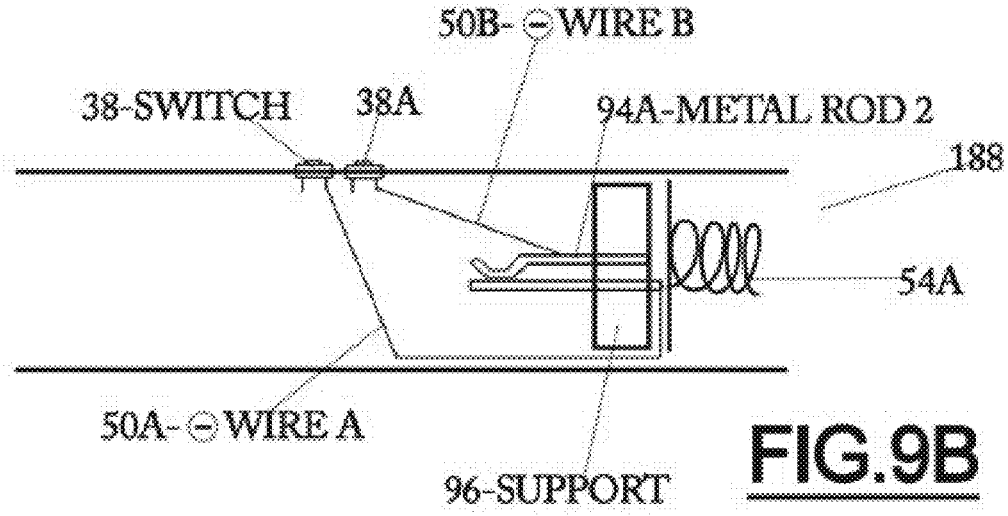

FIG. 9B shows a switch made from two pieces of metal rod 94 and 94A. They are both held by a support, which is attached to the conducting plate 56 at the end of the battery compartment (FIG. 4). The metal rod 94A is bent and touches the metal rod 94. When the hoop moves in certain ways the connection is broken and this sets off a sequence with the lights.

The battery compartment (FIG. 4) is used when rechargeable batteries are not optimum. An example of this is when the hoop is going to be used in places that have no electricity for a charger. Ordinary AA batteries 58 are inserted into either end of the compartment, and then the compartment is slid shut. The join 40 is then taped. A spring 54, at either end of the compartment, keeps the batteries in contact during use of the hoop. The compartment is designed to be just the right size so that electrical connection is not lost during extreme activity with the hoop. This configuration requires two joins in the hoop 40 and 40A. 40A is secured with glue and then taped permanently. This arrangement is ideal for camping trips and continued use outdoors and on the beach. There are less electrical components, no electronic sensors, and the batteries don't have to be recharged. In a normal hoop configuration like this with 20 LEDs, 3 AA batteries can last for 16 hours. The disadvantage of this configuration is that the weight is not balanced and the hoop wobbles slightly when spun in the air. The addition of extra weights in the tubing to balance the hoop is usually counterproductive because of the excess weight. AAA regular batteries with counterweights are a viable alternative, depending on the size of the hoop and tubing.

Figure 10A:
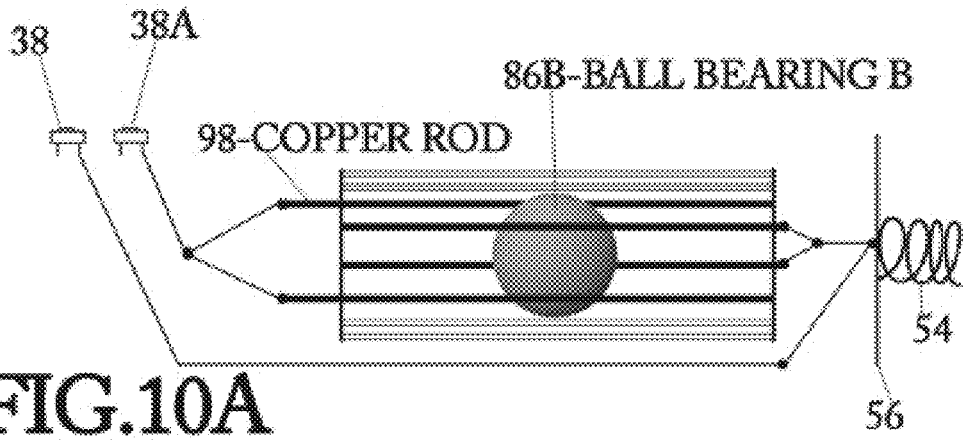
FIGS. 10A, 10B, and 10C show side, plan and detailed views of an electromechanical sensor.
Figure 10B:
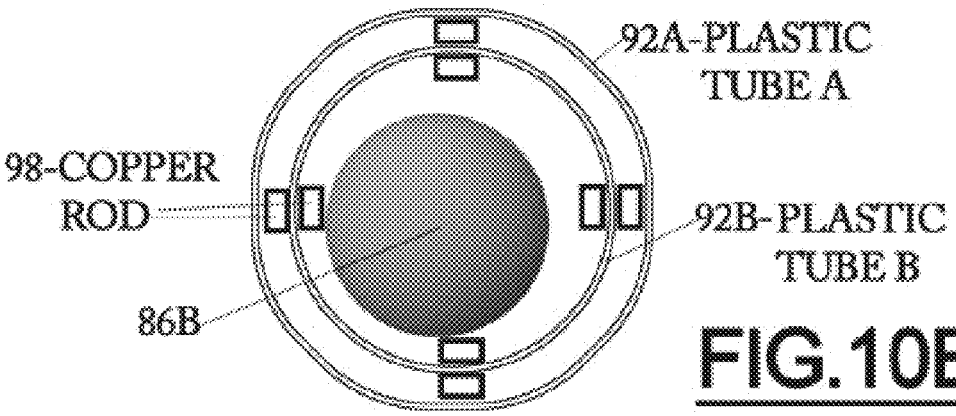
Figure 10C:
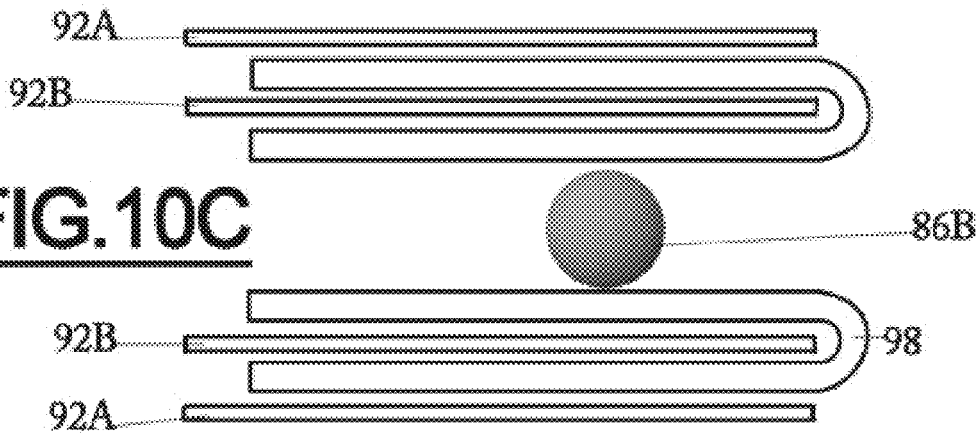

Also used in this alternative embodiment of the hoop is a switch with slightly more complex behavior. FIG. 10A,B,C. The ball bearing 86 is surrounded by a plurality of copper rods 98. These are bent over and held in place by two layers of tubing 92A,92B. As the hoop performs its moves, the ball bearing makes and breaks contact between the copper rods and the lights start and stop their sequences.

This alternative embodiment has no sound component, no electronic sensor, no rechargeable batteries or charger, and so is simpler and cheaper to manufacture. The careful use of tape, and the right placement of different types of LEDs, still allows for the possibility of much interactivity and creativity on the part of the user. Light colors, patterns and trails all vary with the type and quality of movements made by the user. The synergy between the trail patterns and the movements of the performer is still exciting, even with this simple embodiment. To some it has a more "organic" feel and so, with either rechargeable or regular batteries, is a viable alternative.

Figure 14:
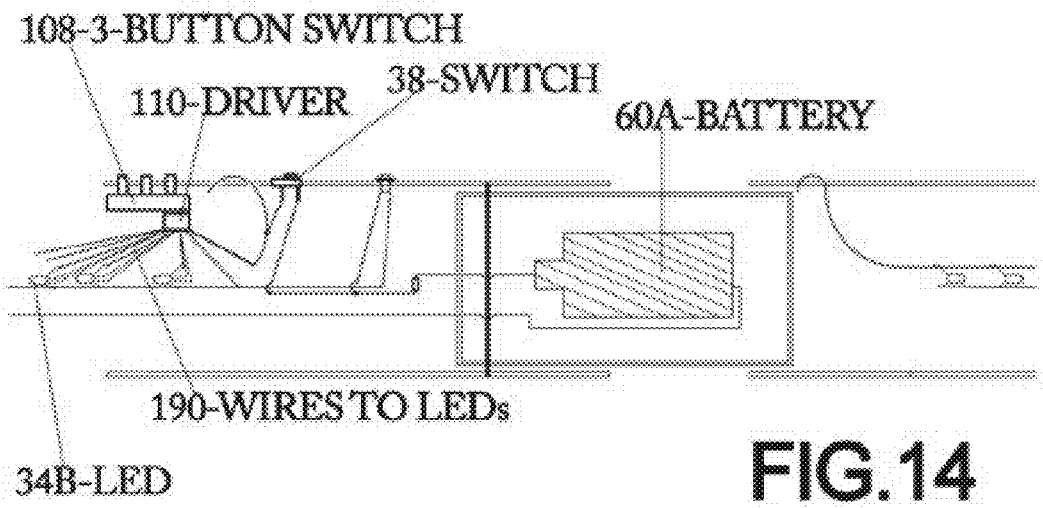
FIG. 14 shows a detailed side view of a button switch for a sequencer
Figure 15A:
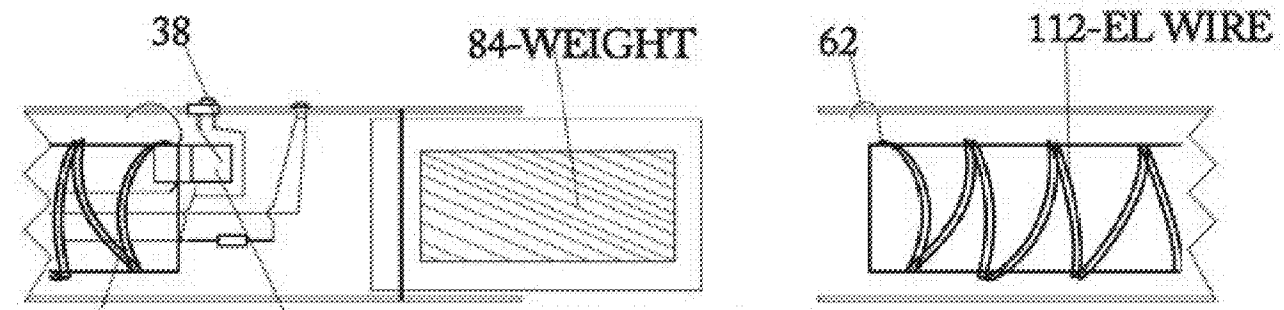

An additional embodiment is illustrated in FIG. 14 where a driver 110 controls the sequences of the LEDs or animates the EL wire 112 (FIG. 15A) The driver is attached to a 3-button switch 108, each button controlling one of the colors of red, green or blue on the LEDs 34B. Preprogrammed sequences can be accessed through a combination of button pushes. Hundreds of programs are accessible through a combination of these 3 buttons, especially since holding down any of these buttons for more than an instant causes a change in the timing of the sequences. The illustration shows individual wires 110A going to the 4 terminal 3 color LEDs 34B. These wires could also be replaced by a chip that communicates from the circuit board 104 (FIG. 11B) to all the LEDs. The 3-button switch is another way to change programs for the light or sound functions of the hoop. It does require some dexterity in finding the right buttons to push, and may thus interrupt a performance, if it is relied on as the sole means to change a program (for the lights or sounds). The 3-button switch is valuable if it is used in conjunction with another kind of signal to the sensor. The buttons can be used prior to the performance or workout or session, to set up the basic program. A quick change in direction of the hoop, or other such signal, can then signal the sensor to change sequences within that basic program.

Figure 15C:
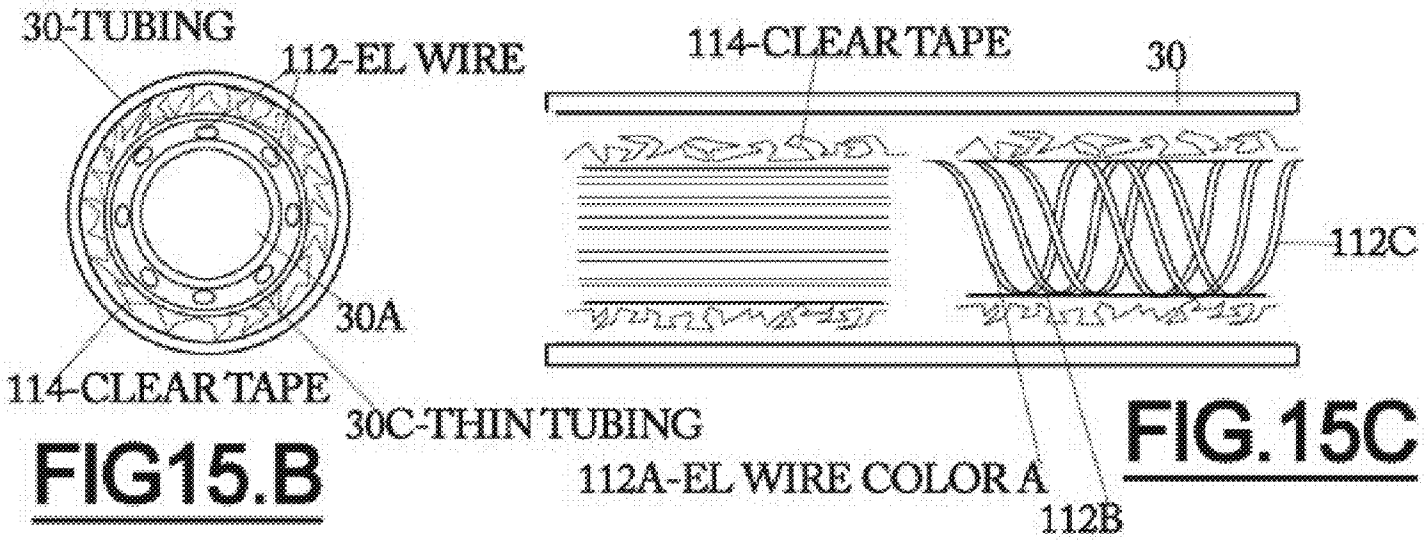

Another additional embodiment is shown where EL (Electro-luminescent) wire 112 (FIG. 15B) is used in place of LEDs. This gives a different look to the lighted hoop. The El wire is wrapped around a clear central tube 30A inside the hoop tubing 30. Different colors can be used and in different combinations. FIG. 15C shows El wire in three strands of different colors A,B,C, arranged longitudinally and in a spiral. The EL wire can be wrapped directly in the clear tape or sheathed in a thin tubing 30C. Three 3V Lithium batteries are used in this embodiment.

Another additional embodiment involves the use of UV LEDs 34A (FIG. 7). The UV LEDs are used in place of the color LEDs. Holes need to be drilled in the tubing at the points where the UV LEDs are pointing, so that the plastic material does not absorb too much of the UV light. The UV LEDs are then held in place with injected foam or glue 80. In one example, a performer can wear black light sensitive clothing. Fluorescent paint or tape can be put directly on bodies or clothes. As the hoop is spun, the lights swing in and out from the body, illuminating different parts with each revolution and creating an interesting effect. This embodiment is really only intended for performers who put on black light show in the dark. The lights are not strong enough to create much effect if there is a lot of ambient light. In the darkness, however, the effect is startling.

Another additional embodiment of the lighted hoop (FIG. 17A) is to have hundreds or thousands of holes drilled all around the tubing, which in this case would be black or opaque, and not taped. The edges of the holes provide enough traction. The light rays are seen emitting through all these holes, and create another interesting variation. A sheath or covering with holes or different patterns could be created from material or wider diameter plastic tubing to put over the preferred embodiment of this hoop instrument. This would give it different looks and displays, which could be put on and taken off easily.

Figure 16D:
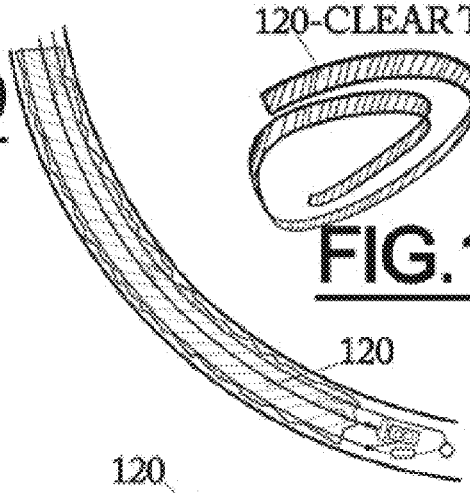
FIGS. 16B to 16H show details of sound reduction systems.
Figure 16E:
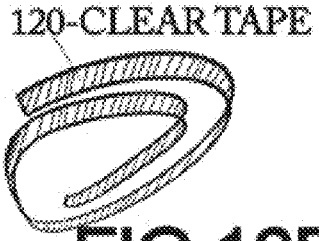
Figure 16C:
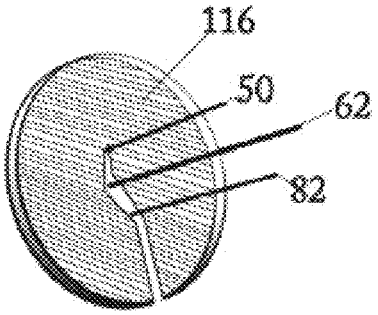
Figure 16F:
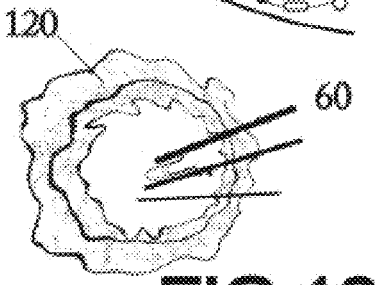
Figure 16B:
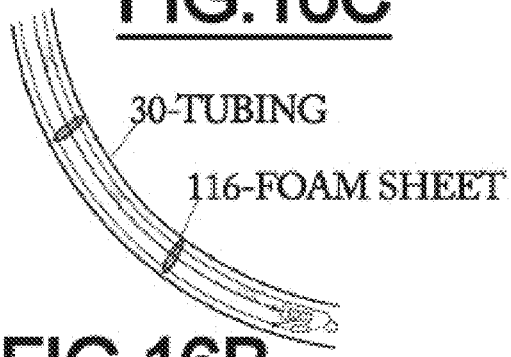
Figure 16G:
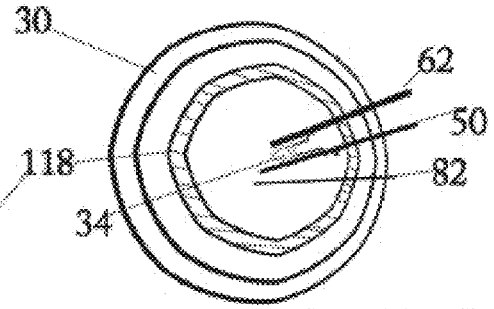
Figure 16H:
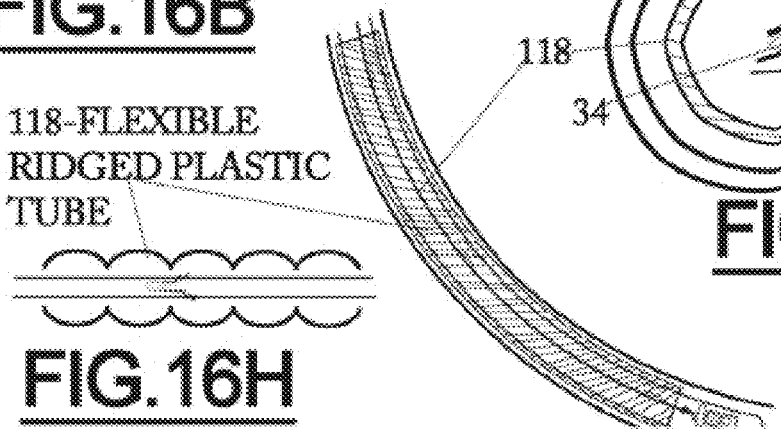

An additional embodiment of this interactive hoop is illustrated in FIGS. 16A,B,C,D,E,F,G,H AND 17B,C,D,E,F. In one example, white pieces of foam sheet are cut and glued at regular intervals around the wires inside the hoop. These act as a noise reduction system, preventing the wires and LEDs from clattering around against each other and the wall of the tubing. The foam pieces also act to reflect light out of the tube, and look like additional LEDs. A flexible ridged thin and slightly opaque plastic tube 118 (FIG. H) can also be used to contain the wires and LEDs and to change the appearance of the inside of the tube and of the light emitted. A clear tube will not greatly affect the brightness of the light. However, completely transparent tubing 30D (FIG. 17E) is not always ideal, however, as it does not scatter the light, and changes the display into more of a 'digital' one than the 'analog' feel. The slightly opaque tubing 30B also allows for greater color mixing. It also hides the wires and bits and pieces inside the hoop. The flexible tubing 118 serves to provide some opaque container for the lights and mix the colors.

Figure 13:
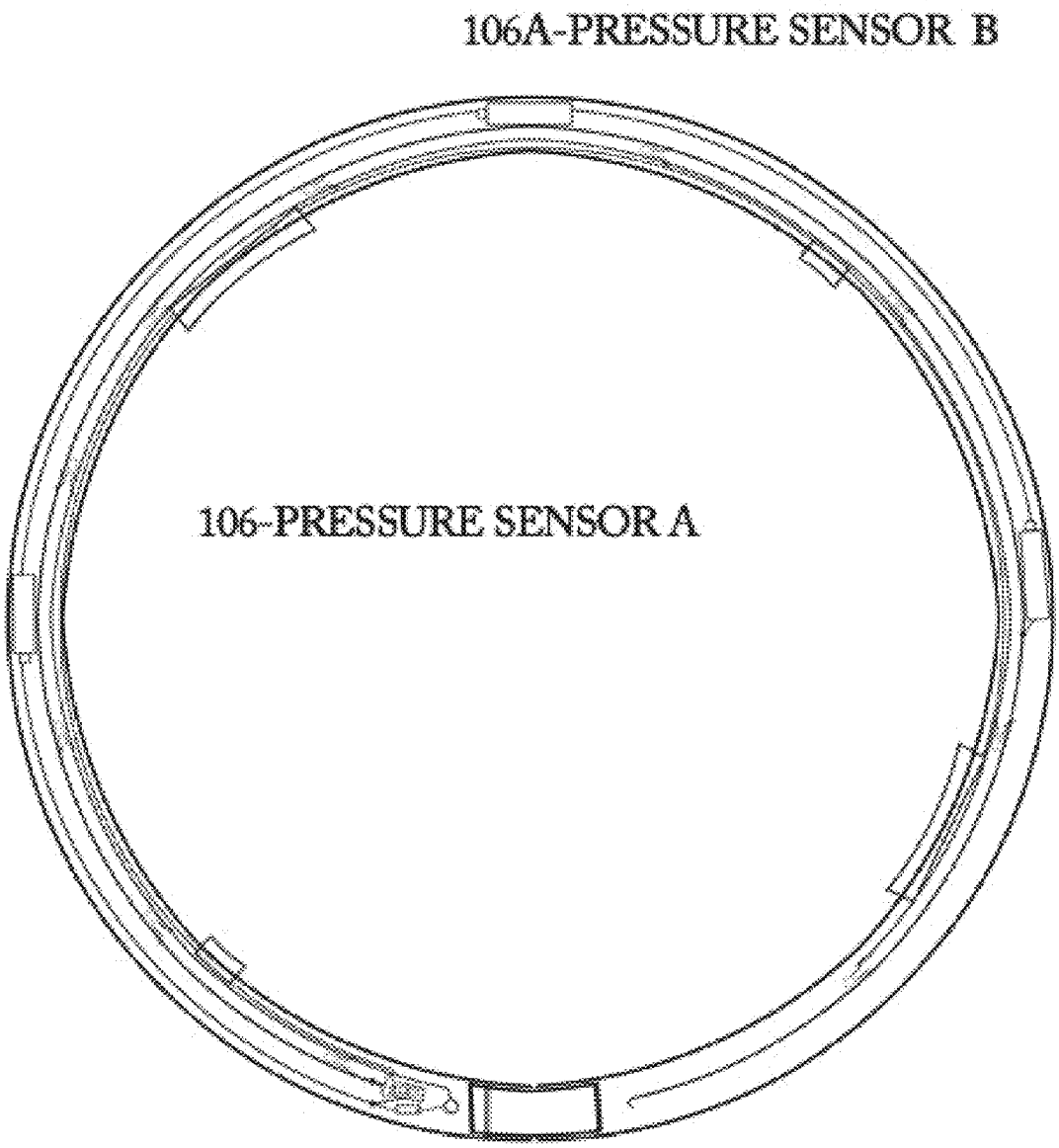
FIG. 13 shows a plan view of a hoop with pressure sensors.
Figure 32:
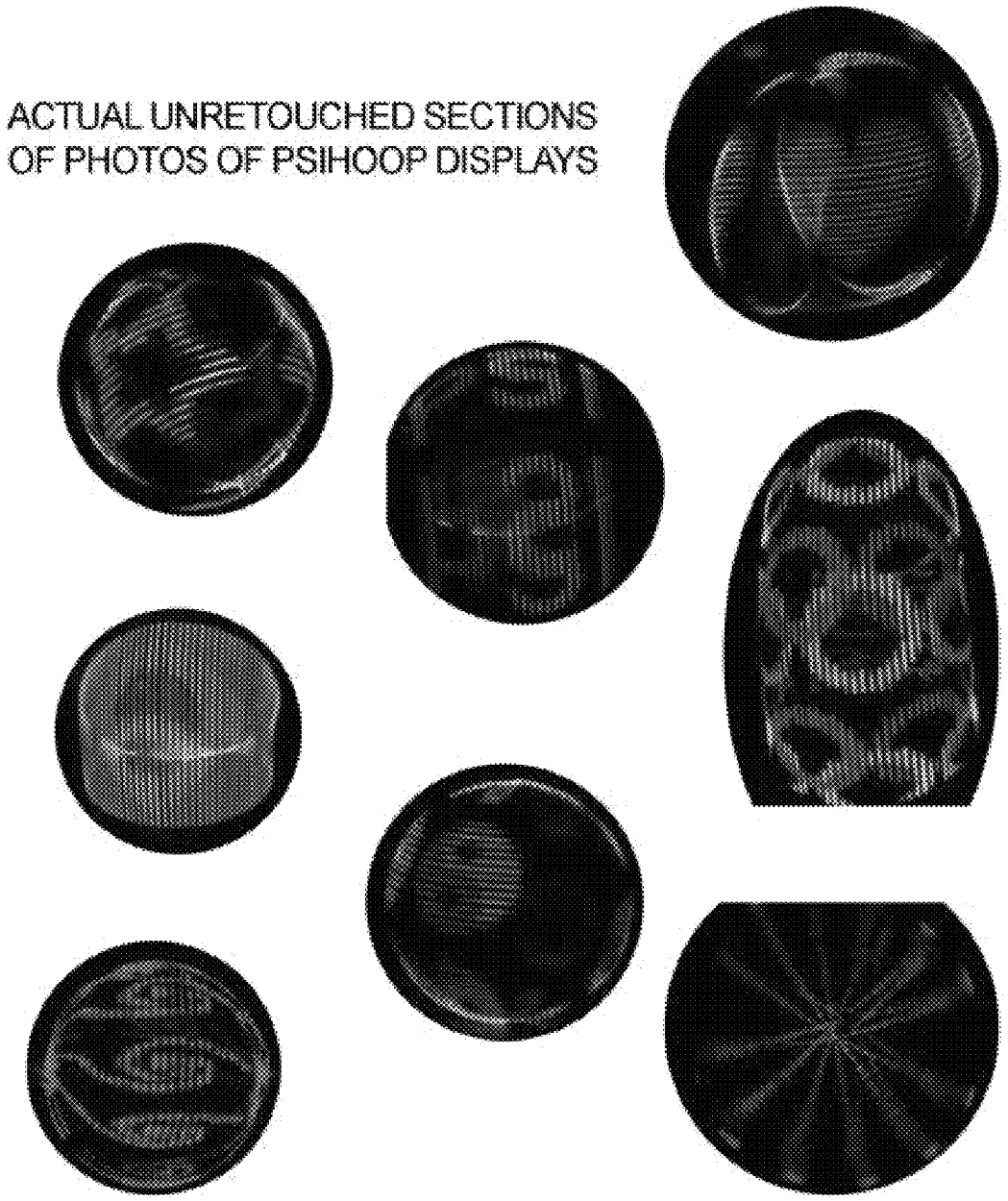
FIG. 32 shows example of hoop displays.

Many kinds of sensors can be used to increase the interactivity, feedback and control of the lights and sounds that can be made with this hoop instrument. Examples of hoop displays are shown in FIG. 32. Another type of sensor is shown in FIG. 13. The pressure sensors 106 and 106A are set into the inside wall of the hoop, where they come into contact with the body parts of the user. They can also be pressed with the hands. The changes in pressure caused by angular momentum, variations in softness of different body parts, or direct manual squeezing of the hoop, causes different signals to be sent to the LEDs directly, in terms of voltage, or to a circuit board which then "talks" to the LEDs. This type of sensor also acts as a mechanism to change programs while the hoop is in use. The sensors stick out slightly from the inside surface of the hoop tubing, so they are easy to find. The pressure sensors 106, 106A can also be placed on the top surface of the hoop so that they don't interfere with the hoop's movement on the surface of the body. In this case the sensors act only from pressure or touch from the hands, and are used solely to control the sequencers or programs on the board.

Figure 28B:
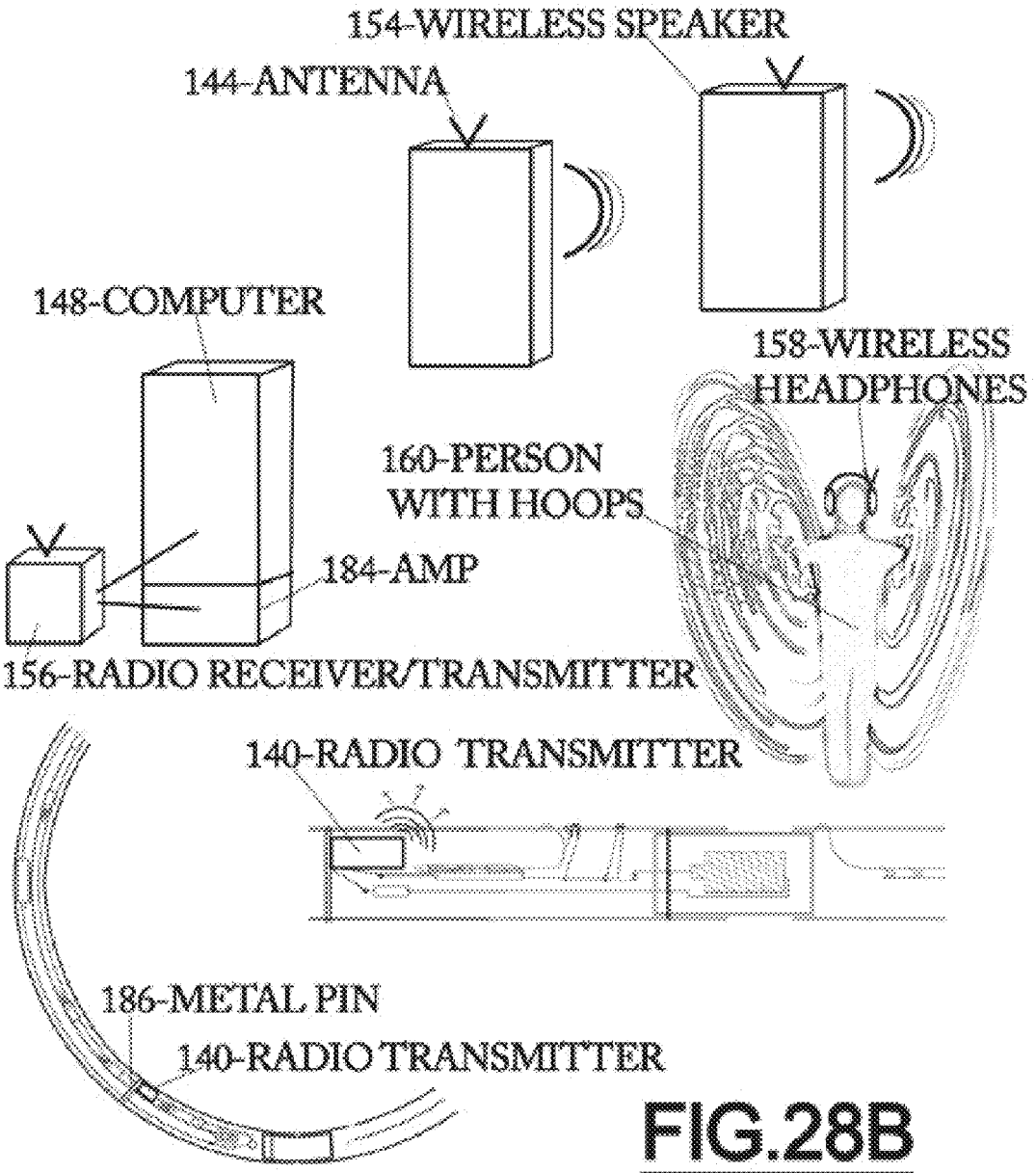
FIG. 28B shows an overview of a performer with headphones and wireless system.

An additional embodiment of the hoop is shown in FIG. 28B. The radio transmitter 140 is held in place by a metal pin 186. The wireless receiver 156, is also a wireless transmitter and sends signals to wireless headphones 158 that can be worn by the user of the hoop.

Figure 28C:
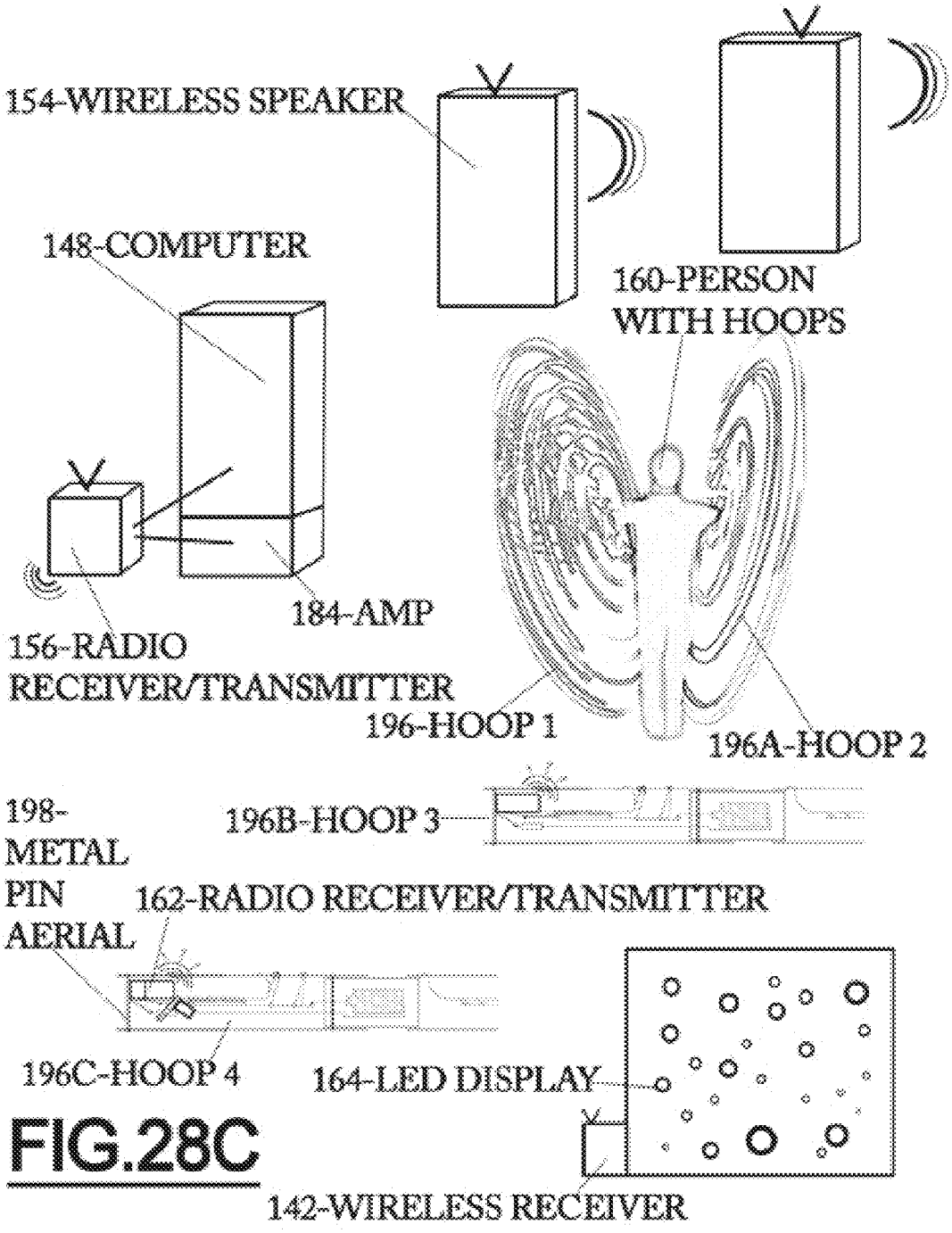
FIG. 28C shows an overview of a performer with another embodiment of a wireless system.

In a further embodiment of the interactive hoop (FIG. 28C) there is a radio receiver/transmitter 162 in the hoop. This allows for networking between different hoops and the computer 148. The signals flow back and forth from hoop to hoop and from hoop to the computer. From the computer 148, wireless 142 or wired connections are made to other display modules 164. The hoop now has the capability of generating a visual display outside of itself. For instance, an ice rink could be equipped with thousands of LEDs embedded in the ice, and the hoop can be used as an instrument by the skater and cause the ice to light up in similar patterns to those that appear in the hoop. Or the walls of a venue can have LCD screens which display the patterns created by the hoop instrument synchronously with the sounds produced by one or more of these instruments. Music concerts could do a similar thing.

When the hoop is not being used as a performance tool it can function as a light show by having its lights flash in time to the music. The music in this case would not be being produced by the hoop. Music created by another source, either from a live musician or recorded music or another hoop performer, could be routed through the computer and the wireless transmitter and received by the hoop, generating a pulsing of the lights in a particular color. The user of the hoop would then adjust other colors through his or her rhythm and movements, to combine them with the signal coming from another source.

A good result utilizing the interactive hoop instrument is with electronic sensors that can continuously measure the movement vectors of the hoop, and output signals that can be interpreted in various ways. The lights, whether individual LEDs or strips of EL wire, can all be individually controlled as to their on/off state, brightness, duration of flash, and combinations with other adjacent color sources to create a multitude of colors, and so forth. The continuation of this application of technology will result in a more and more responsive, coherent and adjustable instrument. The 3-axis accelerometer works well for this job. It is small enough to fit easily on a small circuit board that can go inside the tubing of even the smallest of these hoops.

The information streaming from this sensor can be sent via wireless to a receiver which can interpret the information in many ways. One of these ways is to convert it to a midi stream that can be used like any midi information to generate sound waves that have the characteristics of any of the instruments available in electronic music—giving the hoop the possibility of playing a multitude of rhythms and tones. At a simpler level, the information coming from the hoop can be made to modulate the volume, and pan and pitch of selectable prerecorded pieces of music. The effect of having sound that is synchronized with the movement of the hoop is amazing, to have the movement originate with the user, preferably as in a hoop with the whole body. Most musical instruments can be played sitting down or with very little movement. The hoop as an instrument, however, requires the use of the whole organism. This not only has ramifications for the world of exercise, entertainment, dance, and so on, but also for personal development in terms of kinesthetic awareness, movement, and expression. Hopefully it will find its way into schools, gymnasiums, the Olympic rhythmic gymnastics, homes, backyards and so forth. It could also be of use to therapists, occupational therapists, rehab centers, and so forth. The hoop instrument can function as a biofeedback device. Each individual with their hoop can be playing a different rhythm instrument or have a different musical voice, and the whole hoop orchestra can also be the dance performers in a simultaneous display.

In another embodiment, multifaceted circular shapes, or polygons can be used in place of strict circular hoop. The materials of the hoop tubing could be varied, in terms of transparency, durability, flexibility, traction and so forth, according to needs for control and responsiveness and resiliency. It can be collapsible so that it fits into a small bag for transportation, without reducing the integrity of the tubing and assembled hoop or adding to its weight. It could be made to be more flexible for applications such as a skipping rope, or to join it with other hoops to create new shapes. The hoop instrument can made to be waterproof. In one embodiment, the hoop can be self-powered, with this circular and spiral movement easily powering a lighted and audio capable hoop.

The number of sensors can affect the lag time between movement and display of light or sound. Programs to interpret the data coming from the sensors, so that the user can select a wide range of display possibilities, similar to how a synthesizer allows a whole set of outputs from a single input, say a pressure of one finger on a keyboard can be performed. The "noise" level can be reduced so that a clearer and cleaner signal continues to emerge. Different sensors will be incorporated to transmit information from pressure, heat of the body in its various parts, skin conductance, and even the internal state of the body as to its magnetic and electric fields. In an embodiment, the speakers are made to be onboard so that the audio function becomes truly portable without loss of quality.

None of these statements are meant to limit the use or extent of this interactive synthesizer hoop instrument. The above statements are made to illustrate examples of its use and improvement within the scope of the invention. Thus the scope of the invention should be determined by the appended claims and their legal equivalents and not by the examples given.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

I claim:

1. An interactive instrument, the instrument comprising:

a hoop configured to be rotated around an extremity of a user's body;

a power source within the hoop;

one or more lights within the hoop for displaying at least two colors;

a processor within the hoop configured to execute a set of instructions to activate light trail patterns and image patterns;

means by which the power source, and the processor, and the one or more lights are held within the hoop; and wherein the instructions when executed, cause one or more of the light patterns to be emitted from the one or more lights within the hoop and appearing in the pathway of the hoop, in real time and in response to movements of the hoop, the movements directed by the user of the hoop;

wherein the light trail patterns includes at least one light trail, each light trail determined by at least two of the placement of the one or more lights, the orientation of the hoop, the quantity of the one or more lights, the characteristics of the one or more lights, the taping of the hoop, the shape of the hoop and the pathway of the hoop;

wherein the image patterns comprises at least one of pictures, letters, and symbols;

wherein the light patterns appear outside of the hoop instrument to create an after-image effect; and wherein the hoop instrument includes an orientation control means that controls the light flashes or patterns by the user varying the orientation of the hoop to navigate through the light flashes or patterns and select a light flash or pattern.

2. The interactive instrument of claim 1 wherein the power source is a one or more rechargeable batteries.

3. The interactive instrument of claim 1 wherein light source is comprised of one or more electroluminescent wires.

4. The electroluminescent wires of claim 3 wherein said electroluminescent wires are comprised of several colors.

5. The interactive instrument of claim 1, wherein the instrument additionally comprises a control system.

6. The interactive instrument of claim 5, wherein the control system is comprised of a plurality of mechanical switches and sensors.

7. The interactive instrument of claim 5, wherein the control system is comprised of a plurality of electronic sensors.

8. The interactive instrument of claim 5, wherein the control system is embedded at least partially within each light.

9. The interactive instrument of claim 5, wherein the control system is embedded at least partially outside of the hoop.

10. The interactive instrument of claim 1 wherein said means by which said source of power and said source of light and said control system are held stable is at least one of tape, foam or tubing.

11. The interactive instrument of claim 1, wherein the at least one trail of light is characterized by an interaction between at least two lights.

12. The tape of claim 1, wherein the tape is inside or outside the hoop, and comprises varying widths, lengths, textures, opacities, and colors.

13. The interactive instrument of claim 1 wherein the one or more lights is a plurality of ultraviolet light emitting diodes.

14. A method for generating light emissions in a hoop instrument, the method comprising:

providing the hoop instrument for rotation around an extremity of a user's body;

moving or orienting the hoop instrument in a series of one or more predefined positions;

the hoop instrument comprising:

a power source within the hoop; one or more lights within the hoop for displaying at least two colors;

means for detecting movement, position, and orientation of the hoop in instrument;

a memory within the hoop for storing a set of instructions;

a processor within the hoop configured to execute a set of instructions to activate light trail flashes or patterns and image flashes or patterns;

means by which the power source, and the processor, and the one or more lights are held within the hoop; and executing a set of instructions stored on the memory, in response to the predefined one or more movements executed by the user, for which the instructions cause one or more light flashes or patterns to display originating from within the hoop in real time, wherein the light trail flashes or patterns include, light trails which are affected by at least two of the placement of the lights, the orientation of the hoop, the quantity of the lights, the characteristics of the lights, the interaction of the lights with each other, the taping of the hoop, the shape of the hoop and the pathways of the hoop;

wherein the image flashes or patterns comprise at least one of pictures, letters, and symbols;

wherein the light flashes or patterns appear outside of the hoop instrument to create an after-image effect; and wherein the hoop instrument includes an orientation control means that controls the light flashes or patterns by the user varying the orientation of the hoop to navigate through the light flashes or patterns and select a light flash or pattern.

15. The method of claim 14, further including a sound output, wherein a signal from the means for motion or orientation detection means alters the sound output.

16. The method of claim 14, wherein a signal indicating motion of the hoop generated by one or more of the motion detection means and the orientation detection means causes the lights to change colors.

17. The method of claim 14, wherein a signal indicating motion or orientation of the hoop generated by one or more of the motion detection means and the orientation detection means causes the lights to change brightness.

18. The method of claim 14, where the one or more light flashes or patterns are repeating light flashes or patterns.

19. The method of claim 14, where the one or more light flashes or patterns are predictable flashes or patterns based on a signal received by the motion detection means.

* * * * *